US007950260B2

(12) United States Patent
Kinouchi et al.

(10) Patent No.: US 7,950,260 B2
(45) Date of Patent: May 31, 2011

(54) HEMMING METHOD AND HEMMING APPARATUS

(75) Inventors: Yoshiyuki Kinouchi, Tochigi (JP); Eisaku Hasegawa, Tochigi (JP); Noriko Uematsu, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 594 days.

(21) Appl. No.: 11/993,156

(22) PCT Filed: Jun. 21, 2006

(86) PCT No.: PCT/JP2006/312446

§ 371 (c)(1),
(2), (4) Date: Dec. 19, 2007

(87) PCT Pub. No.: WO2006/137457

PCT Pub. Date: Dec. 28, 2006

(65) Prior Publication Data

US 2009/0139293 A1 Jun. 4, 2009

(30) Foreign Application Priority Data

Jun. 21, 2005 (JP) ..... 2005-180611
Jun. 14, 2006 (JP) ..... 2006-164485

(51) Int. Cl.
*B21D 7/02* (2006.01)
*B23P 11/00* (2006.01)

(52) U.S. Cl. ..... 72/220; 29/243.58

(58) Field of Classification Search ..... 72/210, 72/211, 214, 220; 29/243.519, 243.57, 243.58
See application file for complete search history.

(56) References Cited

U.S. PATENT DOCUMENTS

| | | | | |
|---|---|---|---|---|
| 3,889,618 | A * | 6/1975 | Jarvis et al. | 29/243.57 |
| 6,161,410 | A * | 12/2000 | Shook et al. | 72/220 |
| 6,324,880 | B1 * | 12/2001 | Nakamura | 29/243.58 |
| 7,124,611 | B2 * | 10/2006 | Baulier et al. | 72/220 |
| 7,134,309 | B2 * | 11/2006 | Toeniskoetter | 29/243.58 |
| 2005/0262912 | A1 * | 12/2005 | Toeniskoetter | 72/220 |

FOREIGN PATENT DOCUMENTS

| | | | |
|---|---|---|---|
| DE | 603 00 614 | | 12/2005 |
| JP | 4-253524 | | 9/1992 |
| JP | 5-78327 | | 10/1993 |
| JP | 06344037 | A * | 12/1994 |
| JP | 08174100 | | 7/1996 |

(Continued)

*Primary Examiner* — Teresa M Ekiert
(74) *Attorney, Agent, or Firm* — Rankin, Hill & Clark LLP

(57) ABSTRACT

A movable die 18 including a first groove 52 and a second groove 54 that extend in a direction in which hemming is performed is moved by a robot 22, and is positioned and set with respect to a wheel arch portion 16 in a vehicle 12 on a production line 14. The movable die 18 is mounted, positioned and fixed with respect to the vehicle 12 by a clamping mechanism 58. A guide roller 32 is rolled while the guide roller is engaged with the first groove 52, and a flange 17 is inclined by a conical surface of a tapered roller 38 of a hemming roller 30 that moves in an interlocking manner with the guide roller 32. Next, the guide roller 32 is rolled while the guide roller is engaged with the second groove 54, and the flange 17 is bent by a cylindrical surface of a cylindrical roller 40 of the hemming roller 30. The movable die 18 is separated from the vehicle 12 after the hemming.

16 Claims, 15 Drawing Sheets

FOREIGN PATENT DOCUMENTS

| | | |
|---|---|---|
| JP | 2561596 | 10/1997 |
| JP | 2924569 | 5/1999 |
| JP | 2002-11525 | 1/2002 |
| JP | 2003-103325 | 4/2003 |
| JP | 2005-145185 | 6/2005 |
| JP | 2006-110628 | 4/2006 |

* cited by examiner

HEMMING METHOD AND HEMMING APPARATUS

TECHNICAL FIELD

The present invention relates to a hemming method and a hemming apparatus that bend a flange provided at an end of a workpiece in conformity with a die.

BACKGROUND ART

A hemming of bending a flange erecting from an edge of a panel inward of the panel may be performed on edges of a bonnet, a trunk, doors, and wheel housings of an automobile. As the hemming, a roll hemming of positioning and holding the panel on a fixed die, and bending the flange at the end of the panel while pressing a roller against the flange can be exemplified. Since the bending angle is large in such roll hemming, working may be performed through a plurality of processes, including preliminary bending (or pre-hemming) and finish bending (or main hemming) in consideration of bending precision.

As such roll hemming, a method of setting a workpiece in a die provided for an exclusive process in an exclusive space, and rolling a unit held at a tip of a robot along the flange to perform roll hemming is suggested (for example, refer to JP-Y2-2561596 and JP-B2-2924569). In the method, working is performed with a workpiece placed on the upper surface of a large fixed die.

Further, hemming a rim strip of an end of a workpiece such that the rim strip is pinched and is pressed by a pressing roller while a pressure roller is rolled on a thin and elongate protection strip corresponding to a die in a state where the protection strip is applied to the rim strip is suggested in a flanging apparatus described in JP-A-2006-110628.

In the method of placing a workpiece on the upper surface of a fixed die to perform roll hemming, a fixed die that supports the whole workpiece is needed. Therefore, if the workpiece is large, it is also necessary to make the fixed die large-sized in accordance with the workpiece. Especially, even in a case where roll hemming is performed only on a portion of a workpiece, the fixed die should support not only a spot to be worked but also the whole workpiece. Therefore, a large-sized fixed die is required, which is not rational. Further, when various kinds of roll hemming are required for every portion to be worked, a plurality of corresponding fixed dies are provided, and consequently, keeping and management of the dies are complicated.

Moreover, in the above method, the arrangement and configuration of other peripheral devices are regulated on the basis of a fixed die. As a result, it is necessary to provide an exclusive space and an exclusive process for roll hemming, and it is difficult to provide the exclusive space and process on a normal production line. Accordingly, it is necessary to convey a workpiece between other assembling and working processes, and the workpiece to be applied is limited to a small one that can be conveyed. That is, it is difficult to apply roll hemming to a large workpiece after assembling, and there is a restriction that roll hemming should be performed on every small part before assembling.

From such viewpoints, if roll hemming is performed on a wheel arch, etc. in a production process of automobiles, a sheet metal will be assembled into a white body after roll hemming is performed on the sheet metal in the vicinity of the wheel arch in an exclusive hemming process. As a result, productivity improvements are further desired from viewpoints, such as an output space, conveyance between processes, and assembling time.

On the other hand, in a method described in JP-Y2-2561596, the posture during preliminary bending of a roller unit (FIG. 2 in JP-Y2-2561596) and the posture during bending (FIG. 5 in JP-Y2-2561596) differ greatly. Therefore, time is required for transition between these postures, and the control procedure of the postures is complicated. Moreover, it is difficult to regulate the posture and pressing force of a hemming roller during the preliminary bending, and as shown in FIG. 15, there is a probability that a flange 900 may be unnaturally bent, like being excessively bent or undulated.

Further, in a method described in JP-B2-2924569, a guiding groove is only one. Therefore, different hemming rollers should be used during the preliminary bending and finish bending, and extra time is required for roller replacement. Moreover, since the guiding groove is provided in the front face of the die, the force to be applied to the flange during finishing (FIG. 3C in JP-B2-2924569) may also be distributed to a guide roller that is engaged with the groove, and since the groove serves as a stopper, the force to be applied may be limited.

In the method described in JP-A-2006-110628, the protection strip corresponding to a die cannot be automatically mounted on a workpiece, and a worker should mount separately and manually. However, since a fairly large-sized framework or clamp, etc. is provided in the protection strip so as to mount the protection strip to the workpiece, it is heavy and complicated. Accordingly, there is the same disadvantage as the fixed die in that it is difficult to provide the frame work or clamp on a normal production line.

Further, in JP-A-2006-110628, the pressure roller has a general cylindrical shape, and the protection strip that is in contact with the pressure roller also has a smooth surface. Thus, since the pressure roller and the protection strip cannot be positioned mutually, exact rolling in a desirable direction cannot be made.

Moreover, JP-A-2006-110628 discloses an example in which a sensor roller serving as a third roller is provided so as to position the pressure roller with respect to the protection strip. In this case, the pressure roller is in contact with a side face of the protection strip, and the sensor roller is in contact with one end face of the protection strip. In such a method, since there is the sensor roller on one end face of the protection strip, positioning is made in this direction. However, since there is no positioning means on the other end face, positioning is not made in the opposite direction, but deviation will occur. Further, since three rollers are needed, structure is complicated.

DISCLOSURE OF THE INVENTION

The invention has been made in consideration of such problems. It is therefore an object of the invention to provide a hemming method and a hemming apparatus capable of being applied for general purposes irrespective of the size of a whole workpiece, and capable of being applied even on a production line.

It is another object of the invention to provide a hemming method and a hemming apparatus capable of performing transition between preliminary bending and finish bending in a short time and in a simple procedure.

It is still another object of the invention to provide a hemming method and a hemming apparatus capable of performing rapid and exact positioning and abutting between a workpiece and a die.

It is a still further object of the invention to provide a hemming method and a hemming apparatus capable of setting a hemming roller in a suitable position with respect to a workpiece when hemming is performed using a die.

A hemming method according to exemplary embodiments of the invention includes a positioning step of bringing the surface of a movable die having a guide strip into contact with a workpiece and positioning the movable die so that the guide strip becomes substantially parallel to a flange at an end of the workpiece, a working step of rolling a guide roller while the guide roller is engaged with the guide strip, and performing hemming on the flange by means of a hemming roller that rolls in an interlocking manner with the guide roller; and a separating step of separating the movable die from the workpiece after the hemming.

By using the movable die positioned with respect to a workpiece as such, a size corresponding to a portion to be worked will suffice for the movable die. Thus, the movable die can be applied for general purposes irrespective of the size of a whole workpiece. Further, since the movable die is small-sized as compared with a conventional fixed die, the movable die can be arranged in the vicinity of a production line and is suitably applied to a workpiece to be conveyed.

In this case, if the movable die is mounted, positioned and fixed with respect to a workpiece, the movable die will be more exactly positioned with respect to the workpiece.

The movable die may have a plate shape, the guide strip may be composed of a first guide strip provided on a rear face of the die and on an outer side of the end of the flange, and a second guide strip provided on the rear face of the die and on an inner side of the end of the flange, and the hemming roller may be composed of a tapered roller tapered toward the inner side of the end of the flange, and provided at the tip thereof, and a cylindrical roller formed in a cylindrical shape and provided at the base end thereof. Here, the working step may have a first hemming step of rolling the guide roller while the guide roller is engaged with the first guide strip, and bringing the tapered roller into contact with the flange, thereby inclining the tapered roller, and a second hemming step of rolling the guide roller while the guide roller is in contact with the second guide strip, and pinching the flange and the movable die with the cylindrical roller and the guide roller.

Thereby, the first hemming step serving as preliminary bending and the second step serving as finish bending can be performed using an apparatus having a simple configuration. Further, advancement of the hemming roller will suffice for the transition to the second hemming step from the first hemming step. Thus, working time can be shortened.

Moreover, a hemming apparatus according to exemplary embodiments of the invention is provided with a die whose front face is in contact with a workpiece having a flange and whose rear face is provided with a first guide strip and a second guide strip that are substantially parallel to the flange, a guide roller that is engaged with the first guide strip or the second guide strip according to a process, and a hemming roller that interlocks with the guide roller and performs hemming on the flange. Here, the first guide strip is provided on an outer side of the end of the flange, and the second guide strip is provided on the inner side of the end of the flange. The hemming roller includes a tapered roller tapered toward the inner side of the end of the flange, and provided at the tip thereof, and a cylindrical roller formed in a cylindrical shape and provided at the base end thereof.

Thereby, the first hemming step serving as preliminary bending and the second step serving as finish bending can be performed using an apparatus having a simple configuration. Further, advancement of the hemming roller will suffice for the transition to the second hemming step from the first hemming step. Thus, working time can be shortened, and the transition procedure is simple.

Further, a hemming method according to exemplary embodiments of the invention is a hemming method of bending a flange of a workpiece arranged in a predetermined station using a roller. The method includes a first step of conveying a movable die arranged in the vicinity of the station by means of a die moving means, thereby bringing the die into contact with the workpiece; and a second step of pinching the workpiece by the movable die and the roller, and bending the flange while the hemming roller is rolled on the flange.

As such, according to the die moving means, positioning and abutting between a workpiece and a die can be performed rapidly and exactly.

If the die moving means is an articulated robot that is operable by a program, positioning and abutting between a workpiece and the movable die can be performed more rapidly and exactly.

In the second step, the flange may be bent by moving the hemming roller by means of a roller moving means while the movable die is held in a state where the movable die is brought into contact with the workpiece by the die moving means. As such, when the die moving means and the roller moving means cooperate with each other perform holding of a movable die and hemming, replacement of the movable die is unnecessary, the procedure is simple, and working can be performed in a short time.

If the roller moving means is an articulated robot that is operable by a program, movement of the roller can be performed rapidly and exactly.

The die moving means may hold the hemming roller and the movable die. In the first step, the movable die may be fixed to the workpiece by a positioning and fixing means, and then the movable die may be separated from the die moving means, and in the second step, the flange may be bent by moving the hemming roller by means of the die moving mean while the movable die is held in a state where the movable die is brought into contact with the workpiece by the positioning and fixing means. Thereby, one moving means can be used both for movement of the movable die and for hemming.

The movable die may include a guide strip that becomes substantially parallel to the flange in a state where the movable die has been in contact with the workpiece in the first step, the hemming roller may be connected to a guide roller guided by the guide strip, and in the second step, working may be performed by the hemming roller while the guide roller is rolled following the guide strip. By causing the guide roller to follow the guide strip, the hemming roller can be positioned exactly.

Plural types of the movable dies may be arranged in the vicinity of the station, and the die moving means may acquire the information on of a next workpiece to be conveyed from an external computer, thereby selecting and conveying a movable die corresponding to the next workpiece. Since the movable die is made small-sized, it is possible to handle at a plurality of workpieces at one station. Further, preliminary preparation can be made by acquiring the information on a workpiece in advance from an external computer.

Moreover, a hemming apparatus according to exemplary embodiments of the invention is a hemming apparatus that bends a flange of a workpiece arranged in a predetermined station using a roller. Here, the apparatus includes a movable die arranged in the vicinity of the station, a die moving means that brings the die into contact with the workpiece, a hemming roller that bends the flange while the hemming roller is rolled on the flange, and a roller moving means that moves the hemming roller along the flange.

As such, according to the die moving means, positioning and abutting between a workpiece and a die can be performed rapidly and exactly.

The movable die may include a positioning and fixing means for the workpiece, and the die moving means and the roller moving means are common moving means, and includes a roller holding section that holds the hemming roller, and a die holding section that detachably holds the die.

The movable die may include a guide strip that becomes substantially parallel to the flange in a state where the movable die has been brought into contact with the workpiece, the hemming roller may be connected to a guide roller guided by the guide strip, and working may be performed by the hemming roller while the guide roller is rolled following the guide strip.

The working roller and the guide roller may be arranged in an axially displaceable manner on the basis of the roller moving means while their relative positions are held.

A hemming apparatus according to exemplary embodiments of the invention is a hemming apparatus including a die having a guide strip, a guide roller that is rolled while its axial position is restricted by the guide strip, a hemming roller that performs hemming on the flange, a hemming unit that supports the guide roller and the hemming roller, and a roller moving means that moves the hemming unit so that working may be performed by the hemming roller while the guide roller is rolled following the guide strip. Here, the hemming unit supports either the hemming roller or the guide roller in an axially displaceable manner.

As such, by providing the first strip that guides the guide roller in the die, and by supporting either the hemming roller or the guide roller in an axially displaceable manner, these rollers can be set in suitable positions with respect to a workpiece.

The hemming unit may support the guide roller and the hemming roller in an axially displaceable manner while holding their relative positions. Thereby, the roller can be more suitably set with respect to a workpiece.

According to the hemming method and hemming apparatus according to the exemplary embodiments of the invention, by using the movable die positioned with respect to a workpiece, a size corresponding to a portion to be worked will suffice for the movable die. Thus, the movable die can be applied for general purposes irrespective of the size of a whole workpiece. Further, since the movable die is small-sized as compared with a conventional fixed die, the movable die can be arranged in the vicinity of a production line and is suitably applied to a workpiece to be conveyed.

Moreover, if two first guide strip and second guide strip that are parallel along a hemming direction are provided at a rear face of a die, a hemming roller composed of a tapered roller provided in a tapered shape at the tip thereof, and a cylindrical roller provided in a cylindrical shape at the base end thereof is provided, preliminary bending is performed by rolling of the tapered roller while the guide roller is engaged with the first guide strip, and finish rolling is performed by rolling of the cylindrical roller while the guide roller is in contact with the second guide strip, the transition between the preliminary bending and the finish bending can be performed in a short time and in a simple procedure.

Moreover, in the hemming method and hemming apparatus according to the exemplary embodiments of the invention, positioning and abutting between a workpiece and a die can be performed rapidly and exactly by the die moving means.

According to the hemming method and hemming apparatus according to the exemplary embodiments of the invention, by providing a guide strip that guides the guide roller in the die, and by supporting either the hemming roller or the guide roller in an axially displaceable manner, these rollers can be set in suitable positions with respect to a workpiece.

Other aspects and advantages of the invention will be apparent from the following description and the appended claims.

REFERENCE NUMERALS

10*a*, 10*b*: HEMMING APPARATUS
12: VEHICLE (WORKPIECE)
14: PRODUCTION LINE
16: WHEEL ARCH PORTION
17: FLANGE
18, 70: MOVABLE DIE
20, 20*a*: HEMMING UNIT
22, 72, 74: ROBOT
26: STORAGE RACK
30: HEMMING ROLLER
32: GUIDE ROLLER
38: TAPERED ROLLER
40: CYLINDRICAL ROLLER

49: DIE PLATE
49*a*: FRONT FACE
49*b*: REAR FACE
50: OUTSIDE ARC
52: FIRST GROOVE (FIRST GUIDE STRIP)
54: SECOND GROOVE (SECOND GUIDE STRIP)
58: CLAMPING MECHANISM

BEST MODE FOR CARRYING OUT THE INVENTION

Hereinafter, hemming method and apparatus according to exemplary embodiments of the invention will be described with reference to the accompanying FIGS. 1 to 14.

A hemming apparatus 10*b* according to a first exemplary embodiment and a hemming apparatus 10*a* according to a second exemplary embodiment are apparatuses that are set in an intermediate process in a production line 14 that performs assembling and working of a vehicle (workpiece) 12 in the state of a so-called white body, thereby performing roll hemming on a flange 17 of a wheel arch portion 16 on the side of a left rear wheel. The wheel arch portion 16 has a substantially arc shape of 180°. In the state before working by the hemming apparatuses 10*a* and 10*b*, the flange 17 has a bent shape of 90° that is bent inward from an end 16*a* (refer to a portion shown by two-dot chain lines of FIG. 4) of the wheel arch portion 16.

Figure 1:
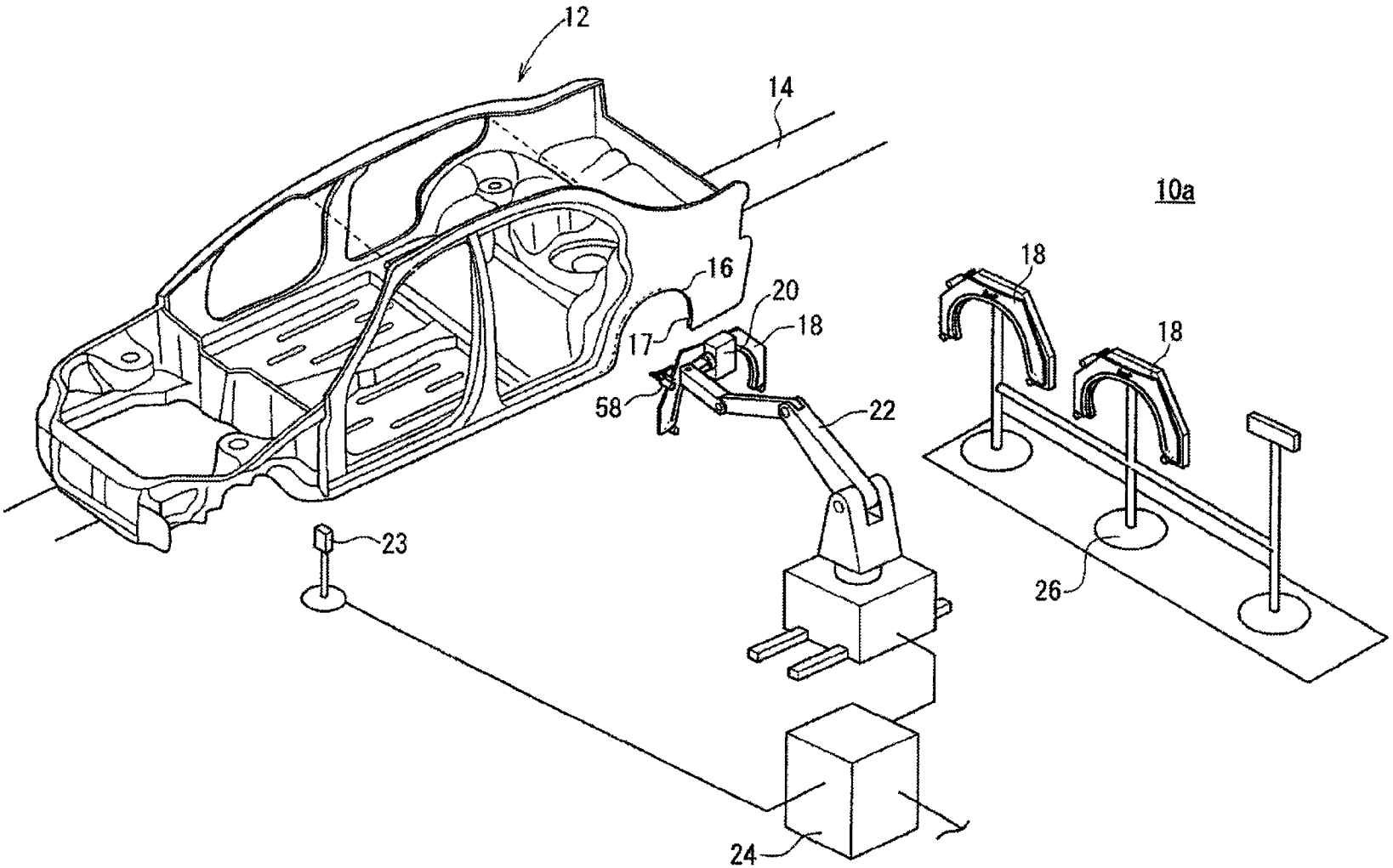
FIG. 1 is a perspective view of a hemming apparatus according to a first exemplary embodiment.

As shown in FIG. 1, the hemming apparatus 10*a* according to the first exemplary embodiment has a movable die 18 that is in contact with the wheel arch portion 16 of the vehicle 12 that is a workpiece, a robot 22 that moves the movable die 18 and has a hemming unit 20 at its tip, a photoelectric sensor 23 that detects that the vehicle 12 is conveyed and arranged to a given position (station) in the production line 14, and a controller 24 that performs general control.

The robot 22 is a stationary industrial multi-joint robot, and is able to move the hemming unit 20 in an arbitrary posture in an arbitrary position by programming operation. A storage rack 26 where a plurality of types of movable dies 18 according to the type of the vehicle 12 are arranged is provided within the operation range of the robot 22 in the vicinity of the robot 22, and the position data of the storage rack 26 is stored in the controller 24. The controller 24 is connected to an external production control computer (not shown) that performs operation control of the production line 14, and the information indicating the type, etc. of the vehicle 12 that is conveyed on the production-line 14 is supplied to the controller 24. The movable die 18 is small-sized and a plurality of the movable dies can be arranged within the operation range of the robot 22. The movable die 18 is lightweight and easy to convey, and the robot 22 is enough to be small-sized, and be of a small output type.

Figure 2:
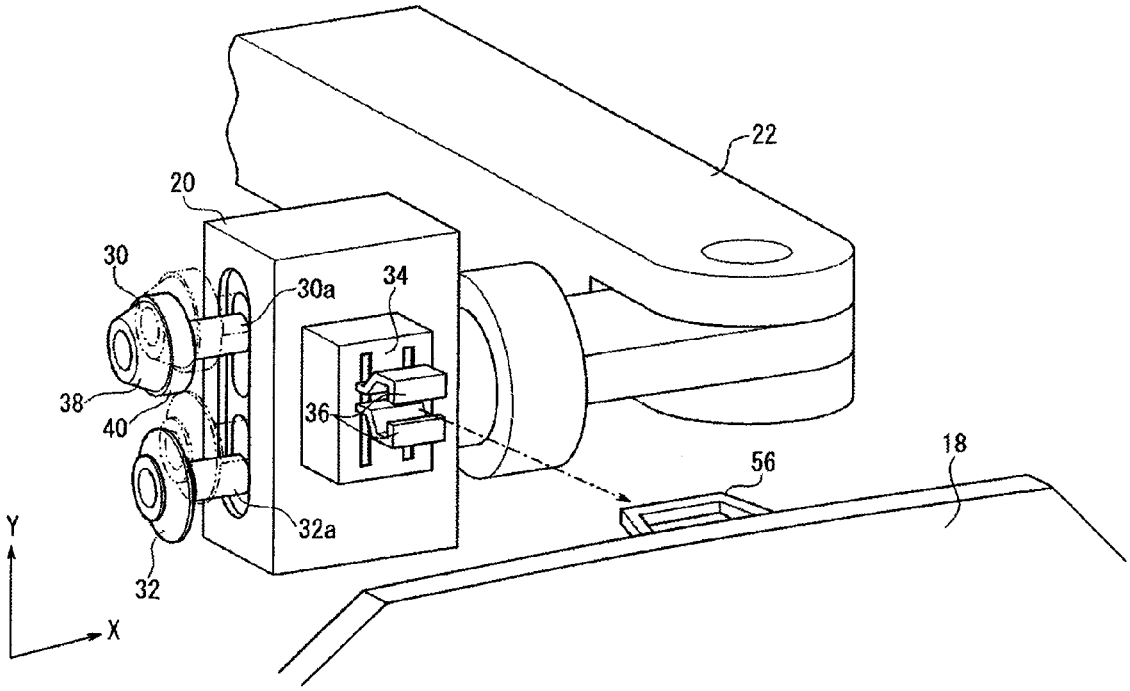
FIG. 2 is a perspective view of a hemming unit provided at the tip of a robot, in the hemming apparatus according to a first exemplary embodiment.

As shown in FIG. 2, the hemming unit 20 has a hemming roller 30 and guide roller 32 that are provided so as to project from an end face thereof, and a chuck (die holding section) 34 provided at a side face thereof. The chuck 34 has a pair of fingers 36 that is opened and closed under the operation of the controller 24, and is used for movement of the movable die 18.

The hemming roller 30 and the guide roller 32 are rotatably journalled to spindles 30*a* and 32*a*, and the hemming roller 30 has a function as a roller holding section. Further, the hemming roller 30 and the guide roller 32 are movable in a Y-direction (a direction in which the spindles 30*a* and 32*a* are located in a line), so that the spacing between the spindle 30*a* and the spindle 32*a* can be adjusted, and a member pinched by the hemming roller 30 and the guide roller 32 can be pressurized.

Moreover, the hemming roller 30 and the guide roller 32 have a so-called floating structure, and are movable even in an X-direction (axial directions of the spindles 30*a* and 32*a*). That is, the hemming roller 30 and the guide roller 32 are movable in the X-direction and in the Y-direction (that is, in an XY plane orthogonal to the rolling direction) while their relative positions are held, and are resiliently moved in a driven manner by an external force. That is, the spindle 30*a* and the spindle 32*a* are movable in an interlocking manner in the X-direction and in the Y-direction, with the adjusted spacing maintained.

Since the hemming roller 30 and the guide roller 32 is able to float in the X-direction and in the Y-direction from the robot 22, even if there is actually an error between the teaching of the robot 22 and the shape of a workpiece, the floating structure absorbs the error, and the hemming roller 30 can be exactly guided along the flange 17, without derailing of the guide roller 32 from a first groove 52 and a second groove 54 for guides to be described later.

In addition, if the axial directions of the hemming roller 30 and the guide roller 32 are not parallel to each other, the X-direction may be set to be the axial direction of the guide roller 32.

Further, the Y-direction may be set to be the direction in which the hemming roller 30 and the guide roller 32 face each other. The Y-direction may be set to coincide with the direction of pressing by a pressing source to be connected with the hemming roller 30 and/or the guide roller 32.

Moreover, the floating direction may include at least the X-direction and the Y-direction, or may further include one or more directions that are not parallel to the X-direction and the Y-direction.

Furthermore, it is preferable that both the hemming roller 30 and the guide roller 32 are made into a floating structure because the hemming roller 30 can follow the flange 17 more exactly. However, even when only the guide roller 32 is made into a floating structure, the hemming roller can follow the flange 17 fairly exactly, and moreover, the structure of the hemming unit 20 can be made simple.

A specific example (FIGS. 12 to 14) having a floating structure will be described later.

The hemming roller 30 has a tapered roller 38 provided at the tip thereof, and a cylindrical roller 40 provided at a base end thereof integrally with the tapered roller 38. The tapered roller 38 is a truncated cone having a tapered shape that is inclined at 45° in side view, and the ridgeline length L1 of the tapered roller is set to be slightly longer than the height H of the flange 17. The cylindrical roller 40 has a cylindrical shape that is slightly larger in diameter than the maximum-diameter portion of the tapered roller 38 at its base end, and the axial height L2 of the cylindrical roller is set to be slightly smaller than the height H of the flange 17.

The guide roller 32 has a disc-like shape that is set to a narrow width at its periphery, and is capable of being engaged with the first groove (first guide strip) 52 or second groove (second guide strip) 54 (refer to FIG. 4) that is provided in the movable die 18. The X-directional position of the guide roller 32 coincides with the position of the center (L2/2) of the height L2 of the cylindrical roller 40 of the hemming roller 30 (refer to FIG. 4).

Figure 3:
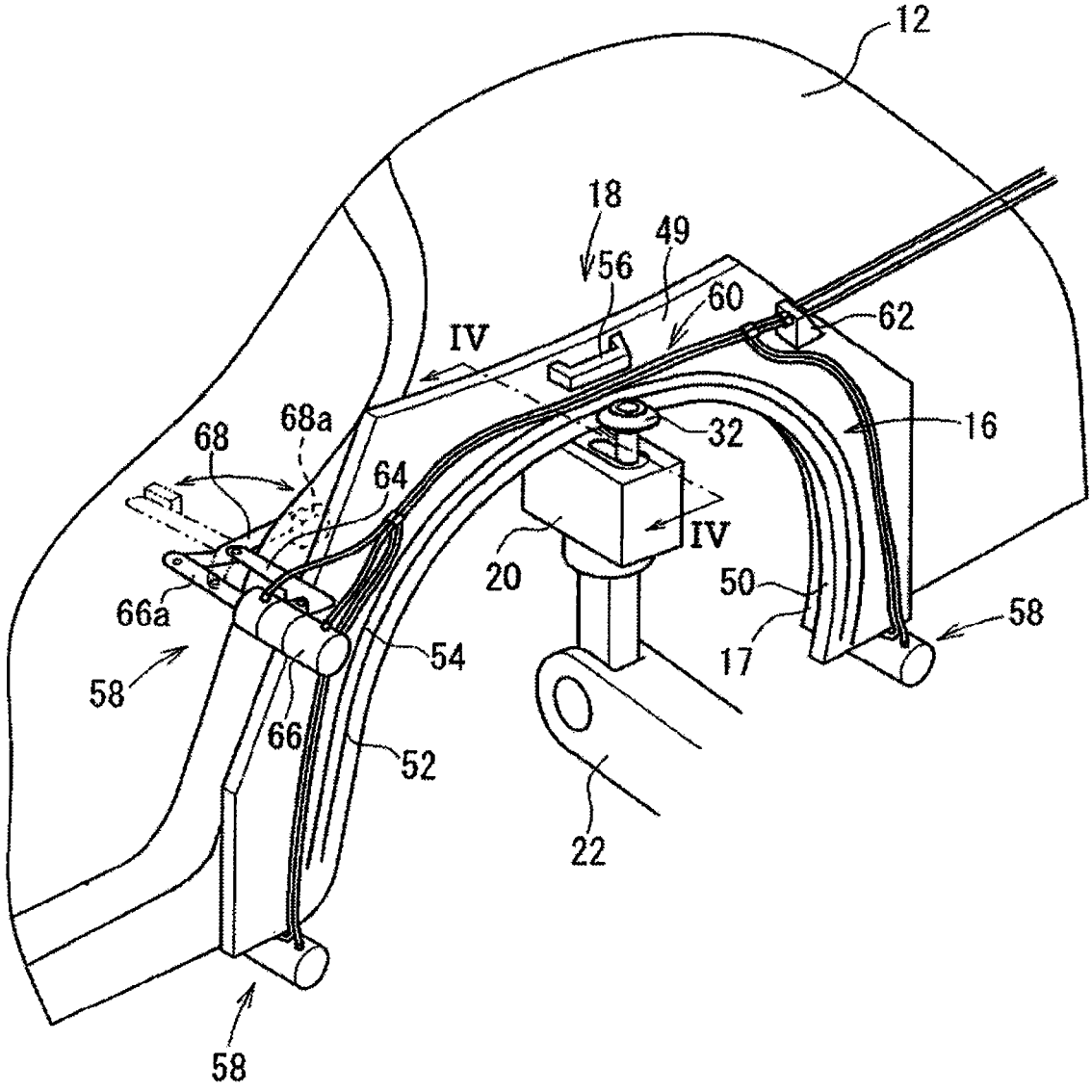
FIG. 3 is a perspective view of a movable die fixed to a wheel arch portion.

As shown in FIG. 3, a die plate 49 of the movable die 18 constitutes a base. The die plate 49 is plate-like, and both faces of the die plate are distinguished from each other by calling the face of the die plate brought into contact with the wheel arch portion 16 a front face 49*a* (refer to FIG. 4) and calling the face of the die plate opposite a rear face 49*b*. Further, both sides of the wheel arch portions are distinguished from each other by calling the workpiece side as seen from the end 16*a* of the wheel arch portion 16 the inner side and calling the side opposite to the inner side the outer side.

The die plate 49 has an arched plate shape in which the front face 49*a* is in contact with the periphery of the wheel arch portion 16, and the front face 49*a* is set as a three-dimensional curved face conformed to the surface shape of the vehicle 12. Accordingly, when the movable die 18 is attached to the wheel arch portion 16, the first groove 52 and the second groove 54 are disposed parallel to (or substantially parallel to) the flange 17, and the front face 49*a* is brought into surface contact with the vehicle 12 over a broad area.

The movable die 18 has an outside arc 50 that is formed further outer side than the end 16*a* of the wheel arch portion 16, a first groove 52 and a second groove 54 that are provided parallel to each other along the outside arc 50 in the rear face 49*b*, a knob 56 that is provided on the rear face 49*b*, three clamping mechanisms (positioning and fixing means) 58 that are provided at the periphery, piping 60 that supplies or recovers compression fluid to or from the clamping mechanisms 58, and a control valve 62 that performs switching control, etc. of the fluid supply direction of the piping 60. The control valve 62 is controlled by the controller 24. The first groove 52 is projected on an outer side than the end 16*a* of the flange 17 on the die plate 49, and the second groove 54 is provided on an inner side of the end 16*a*.

The movable die 18 is small-sized since it is brought into contact only with the periphery of the wheel arch portion 16. Further, since the movable die is brought into contact with the vehicle 12 from a side face, the weight of the vehicle 12 is not applied to the movable die, and the movable die is not an anti-load structure. Therefore, the movable die is set lightweight. Accordingly, the movable die 18 can be simply and easily moved by the robot 22 by grasping the knob 56 using the chuck 34 (refer to FIG. 1).

The clamping mechanism 58 has a stay 64 extending from the end of the die plate 49, a cylinder 66 swingably provided in the stay 64, and an opening and closing lever 68 that is tilted about a spindle provided in the stay 64. One end of the opening and closing lever 68 becomes a grasp portion 68*a* that is engaged with and holds the vehicle in the reference position of the vehicle 12, and the opposite end of the opening and closing lever is rotatably coupled with a rod 66*a* of the cylinder 66 via a spindle. That is, the rod 66*a* of the cylinder 66 is protruded and thereby the opening and closing lever 68 closes so that the vehicle 12 can be held by the grasp portion 68*a*, while the rod 66*a* is retracted and thereby the opening and closing lever 68 opens so that the movable die (refer to a portion shown by two-dot chain lines of FIG. 3) 18 can be brought close to or separated from the vehicle 12. Although the stop position of the vehicle 12 on the production line 14 may slightly shift from a specified value, the movable die 18 is exactly positioned with respect to the wheel arch portion 16 by the clamping mechanism 58.

Figure 4:
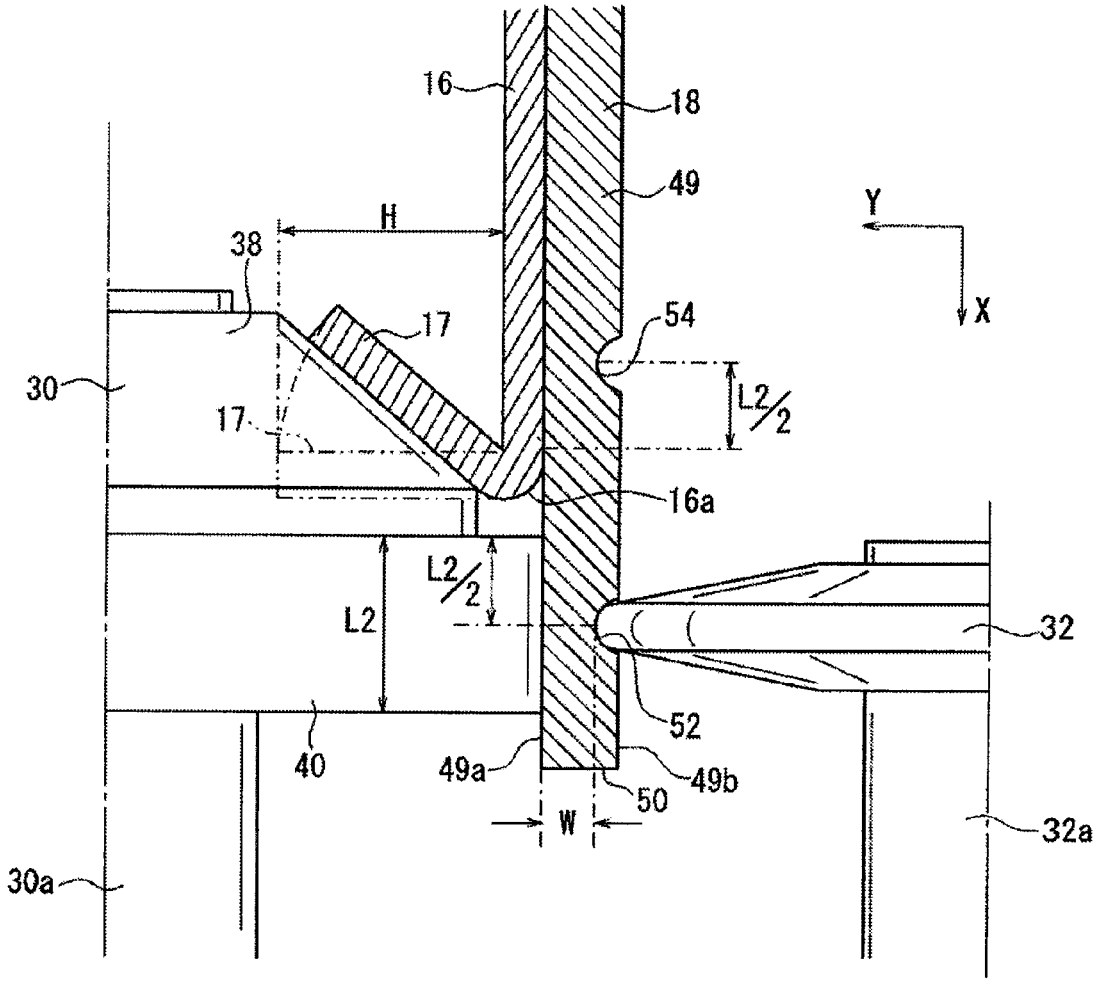
FIG. 4 is an enlarged sectional view as seen from the direction of the arrow IV-IV in FIG. 3.

When the movable die 18 is fixed to the wheel arch portion 16 by the clamping mechanism 58, as shown in FIG. 4, the outside arc 50 is arranged on the outer side of the end 16*a* of the wheel arch portion 16 (lower side of FIG. 4). The first groove 52 is positioned on a slightly outer side of the end 16*a*, and specifically the first groove is arranged slightly outer by half (L2/2) of the height L2. The second groove 54 is positioned slightly inner than the end 16*a*, and specifically the second groove is arranged slightly inner by half (L2/2) of the height L2 of the cylindrical roller 40. That is, the first groove 52 and the second groove 54 are arranged parallel to each other along the end 16*a* in positions that are substantially symmetrical with respect to the end 16*a*.

Figure 5:
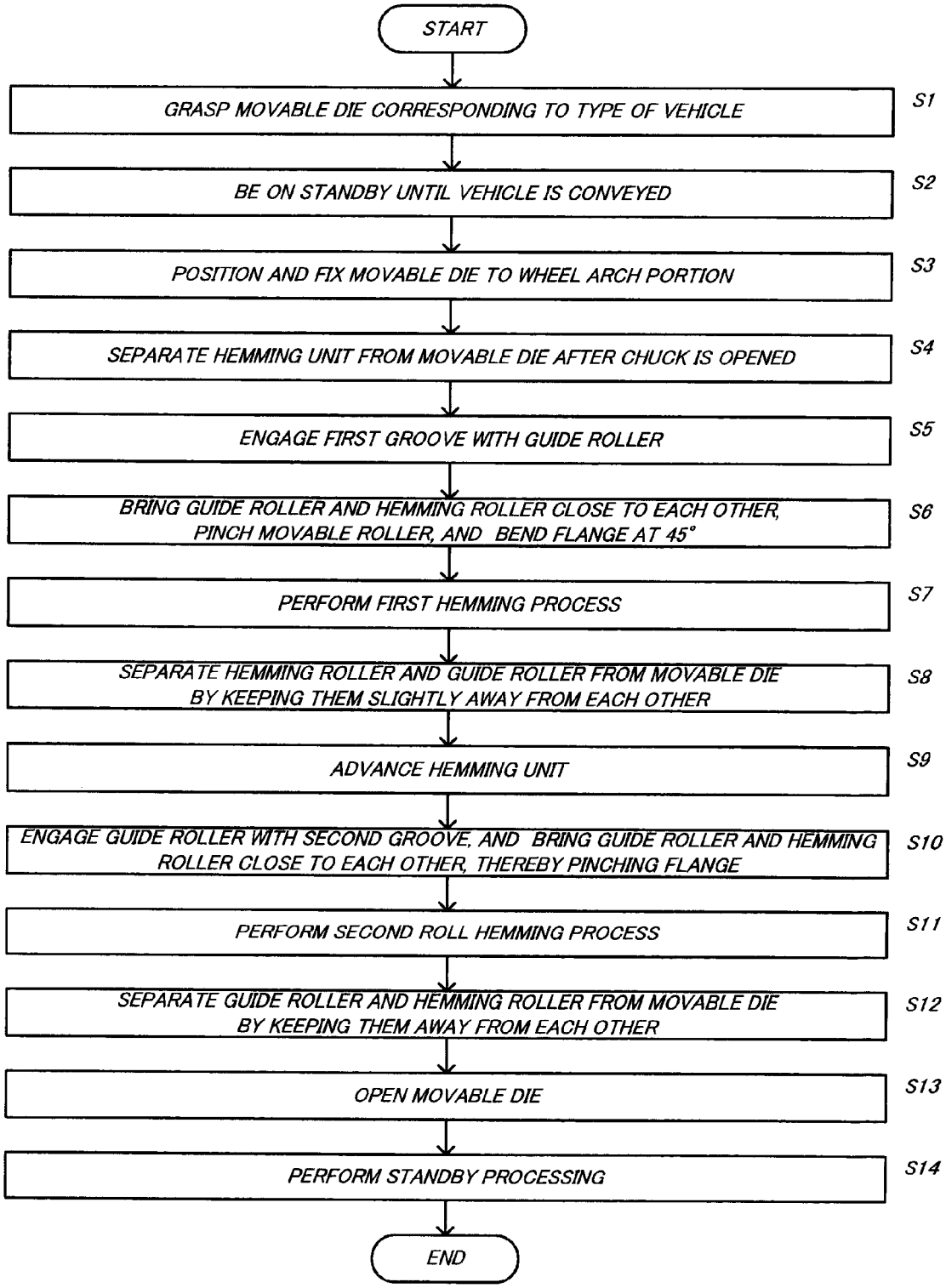
FIG. 5 is a flow chart showing the procedure of a hemming method by the hemming apparatus according to the first exemplary embodiment.

Next, the working method of performing roll hemming of the flange 17 of the wheel arch portion 16 using the hemming apparatus 10*a* configured in this way will be described referring to FIG. 5. The processing shown in FIG. 5 is executed by the movable die 18, the hemming unit 20, and the robot 22 under control mainly by the controller 24.

First, in Step S1, after the information on the type of a vehicle 12 to be conveyed next is confirmed from a production control computer, the robot 22 returns the currently grasping movable die 18 to the specified position of the storage rack 26, and grasps another movable die 18 corresponding to the type of the vehicle by means of the chuck 34. It is a matter of course that, if the robot already holds a corresponding movable die 18, this replacement work is unnecessary, and when a plurality of vehicles 12 of the same vehicle type are continuously conveyed, it is not necessary to replace the movable die 18.

In Step S2, the robot is on standby until it confirms the signal of the photoelectric sensor 23 and a vehicle 12 is conveyed. The vehicle 12 is conveyed by the production line 14 and is stopped in a given position in the vicinity of the robot 22. The processing proceeds to Step S3 when conveyance of the vehicle 12 has been confirmed by the photoelectric sensor 23.

In Step S3, the robot 22 is operated to bring the front face 49*a* of the movable die 18 into contact with the wheel arch portion 16 of a vehicle 12, and the control valve 62 is driven for switching to switch the opening and closing lever 68 of the clamping mechanism 58 to close. Thereby, the movable die 18 is mounted and exactly positioned and fixed with respect to the wheel arch portion 16. That is, in this Step S3, since the vehicle 12 that is a large-sized heavy load is completely stopped, and the small-sized lightweight movable die 18 is brought close to the vehicle, positioning and fixing is made simple.

In addition, the movable die may be brought close to the vehicle while the route of the robot 22 is corrected while the position of the movable die 18 relative to the wheel arch portion 16 is confirmed in real time by a predetermined sensor. Further, the positioning may be performed by providing a reference pin in the movable die 18, and by inserting the reference pin into a predetermined reference hole of the vehicle 12. It is needless to say that these positioning means may be used together.

In Step S4, the hemming unit 20 is separated from the movable die 18 after the fingers 36 of the chuck 34 are opened.

In Step S5, the outside arc 50 of the movable die 18 is brought close to the vehicle, and the first groove 52 is engaged with the guide roller 32, after the direction of the hemming unit 20 is changed. In Step S6, the guide roller 32 and the hemming roller 30 are brought close to each other, and as shown in FIG. 4, the movable die 18 is pinched by the guide roller 32 and the cylindrical roller 40. At this time, the flange 17 is pressed by the tapered roller 38, and is inclined and bent at 45° along the conical surface. Further, as clear from FIG. 4, the distance between the guide roller 32 and the cylindrical roller 40 is specified to the width w of the bottom of the first groove 52, and the front face 49*a*, and the rollers are not brought close to each other excessively. Accordingly, the flange 17 is not bent more than a prescribed amount, or is not formed into an undulated shape. Moreover, since the guide roller 32 and the cylindrical roller 40 are arranged to face each other such that the X-directional positions thereof coincide with each other, the movable die 18 can be pinched surely. This prevents occurrence of elastic deformation or deviation, without applying moment to the movable die 18.

Figure 6:
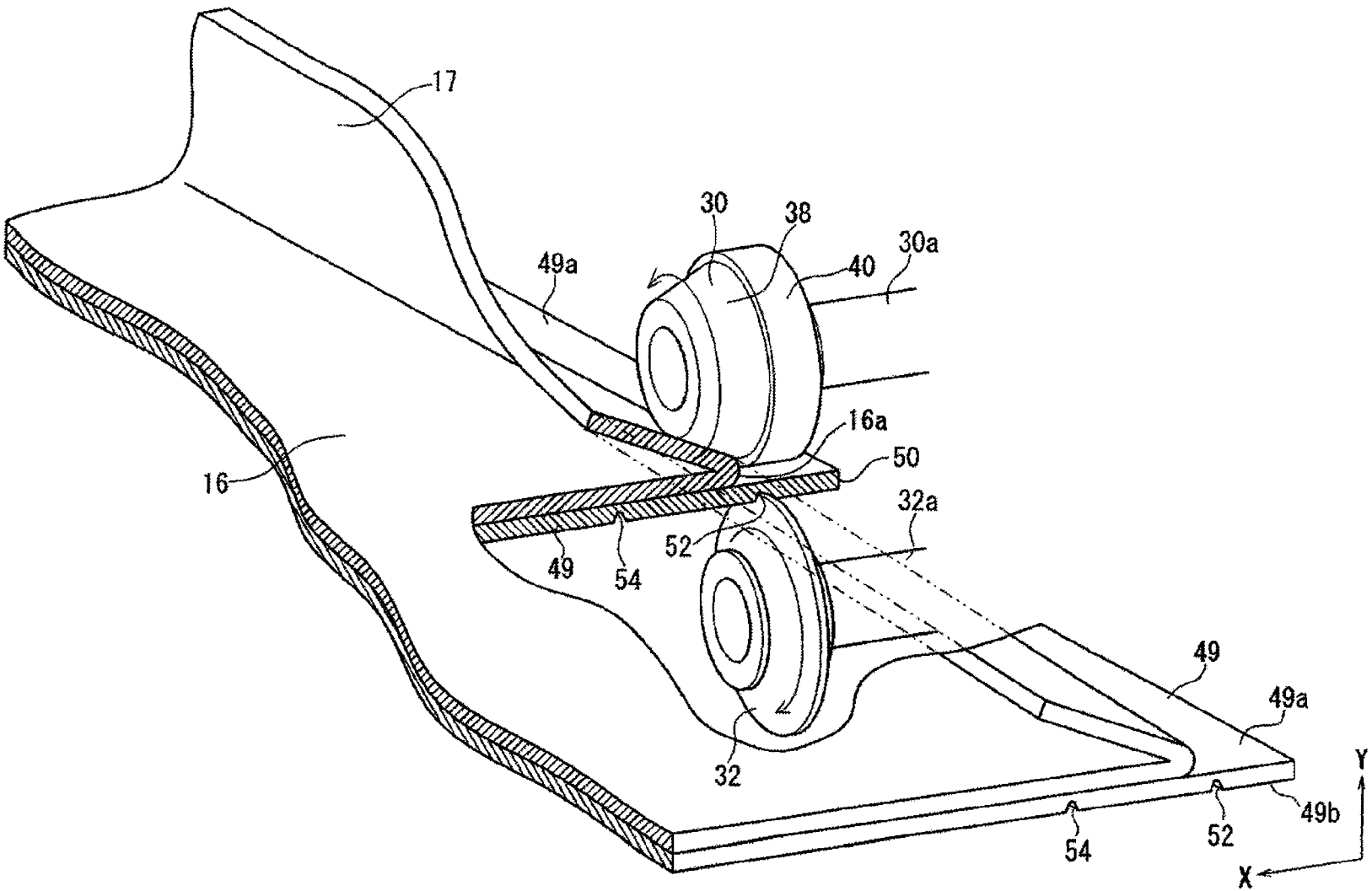
FIG. 6 is a partial cross-sectional perspective view of a workpiece, a hemming roller, and a guide roller when a first hemming process is performed.

In Step S7, as shown in FIG. 6, a first hemming process of rolling the guide roller 32 while the guide roller is engaged with (follow) the first groove 52, thereby inclining and bending the flange 17 at 45° inward, is continuously performed. That is, the first hemming process is performed by rolling the hemming roller 30 and the guide roller 32 while they rotate in mutually opposite directions, and bending the flange 17 continuously by means of the conical surface of the tapered roller 38. At this time, since the hemming roller 30 and a guide roller 32 have a floating structure, they can be displaced in the X-direction and in the Y-direction. Thus, even if there is a slight error in the locus of the operation of the robot 22, the guide roller 32 can move to follow the first groove 52 exactly. Accordingly, the tapered roller 38 can press and deform the flange 17 in a prescribed direction. Further, since the operational precision of the robot 22 does not need to be extremely high, the operation speed is increased and the control procedure is simplified. The hemming by the first hemming process is performed over the total length of the flange 17.

Further, as clear from FIG. 6 (and FIG. 8), the first groove 52 (and the second groove 54) specifies the X-directional position of the guide roller 32 and also specifies the Y-directional position of the guide roller. As a result, exact positioning is made. Since the position of the hemming roller 30 relative to the guide roller 32 is held, exact positioning is made similarly to the guide roller 32.

Figure 7:
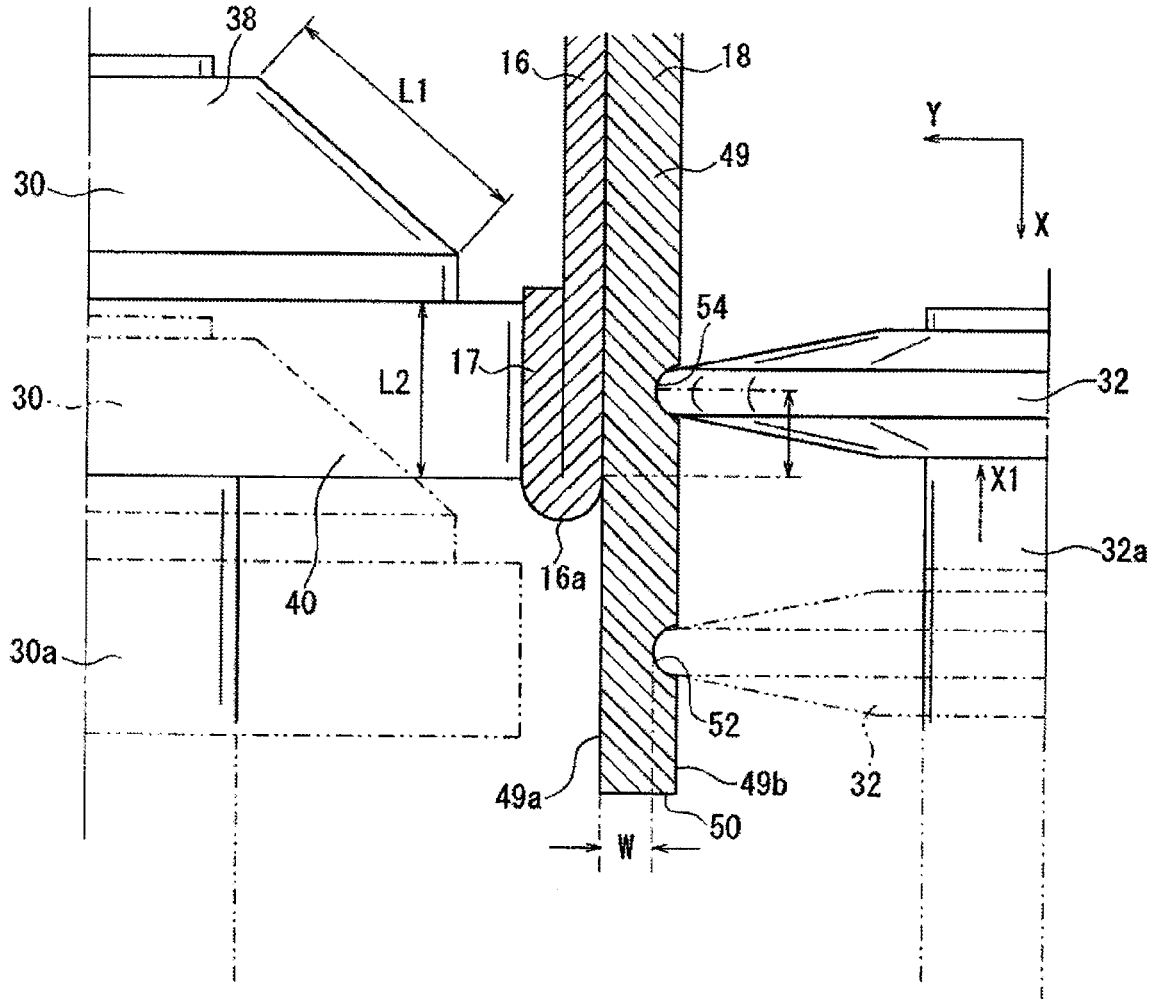
FIG. 7 is a sectional view showing the positions of the hemming roller, the guide roller, a flange, and the movable die during a second hemming process.

In Step S8, as shown by two-dot chain lines of FIG. 7, the hemming roller 30 and the guide roller 32 are separated from the movable die 18 by keeping them slightly away from each other.

In Step S9, the hemming roller 30 and the guide roller 32 are advanced in the direction of an arrow X1 by advancing the hemming unit 20. This advance distance is equal to the distance between the first groove 52 and the second groove 54, and is slightly longer than the height L2 of the cylindrical roller 40.

In Step S10, the second groove 54 is engaged with the guide roller 32. Moreover, the guide roller 32 and the hemming roller 30 are brought close to each other, and as shown in FIG. 7, the movable die 18 is pinched and pressed by the guide roller 32 and the cylindrical roller 40. As such, the operation procedure when the guide roller 32 is moved to the second groove 54 from the first groove 52 is simple, and the hemming unit 20 may be advanced in the direction of the arrow X1 while its direction remains constant. Further, since the moving distance is also short, transition is completed in a short time.

At this time, the flange 17 is pressed by the tapered roller 40, and is bent until the flange 17 is brought into contact with the rear face of the wheel arch portion 16. That is, the flange 17 will be further bent at 45° from the first hemming process, and will be bent at 90° from its original angle.

Figure 8:
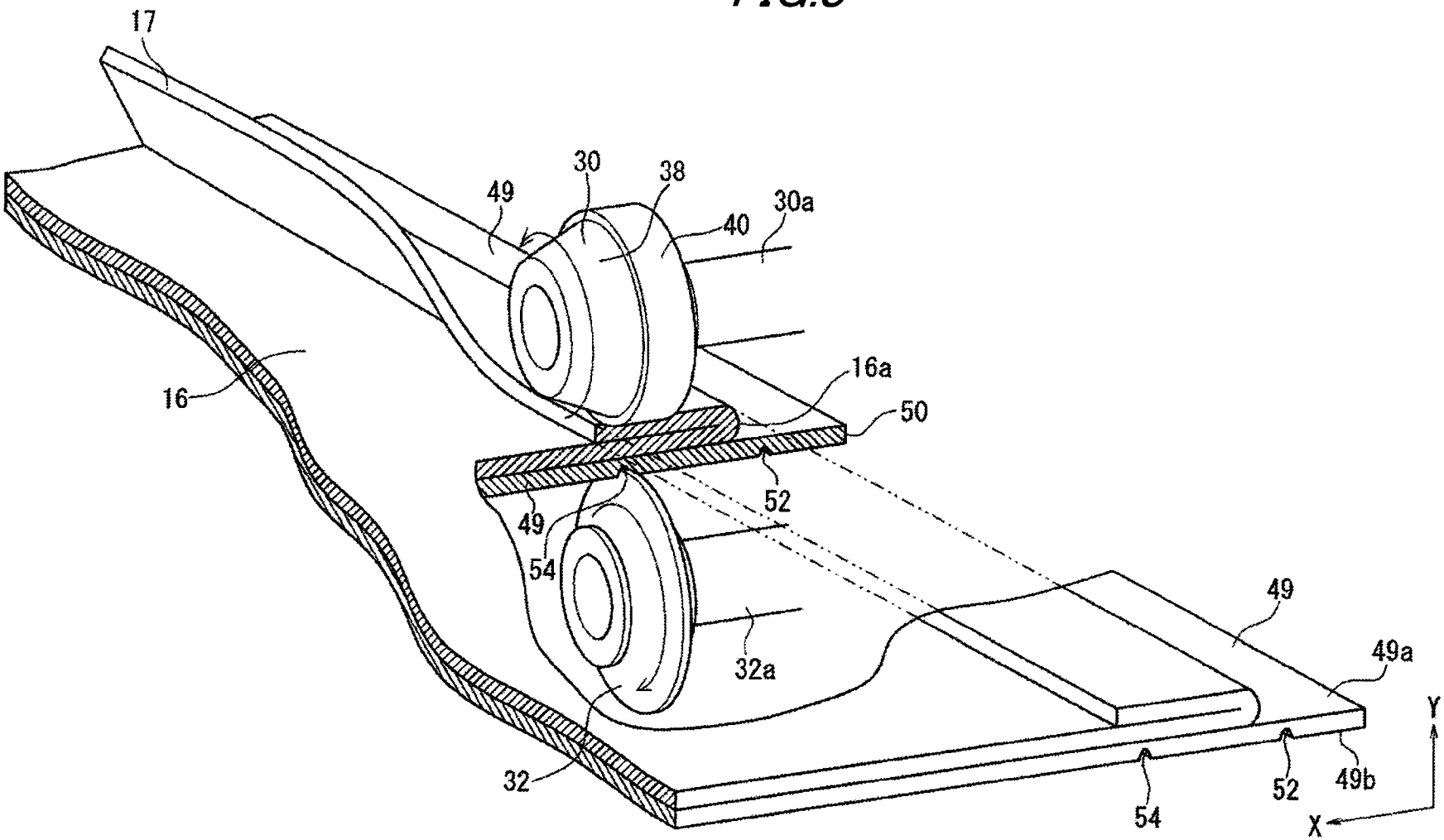
FIG. 8 is a partial cross-sectional perspective view of the workpiece, the hemming roller, and the guide roller when the second hemming process is performed.

In Step S11, as shown in FIG. 8, a second hemming process of rolling the guide roller 32 while the guide roller is engaged with (follow) the second groove 54, thereby bending the flange 17 until the flange 17 is brought into contact with the rear face of the wheel arch portion 16, is continuously performed. That is, the second hemming process is performed by rolling the hemming roller 30 and the guide roller 32 while they rotate in mutually opposite directions, and bending the flange 17 continuously by means of the peripheral cylindrical surface of the cylindrical roller 40.

Further, since the second groove 54 is provided at the rear face 49*b* of the die plate 49, the flange 17 and the die plate 49 are pinched and surely pressed between the cylindrical roller 40 and the guide roller 32, and a pressing force is concentrated on and acts on the flange 17 without being distributed to other places and with no stopper that restricts the pressing force. Thereby, the flange 17 is surely bent.

Even as for the second hemming process, similarly to the first hemming process, the guide roller is moved along an exact route along the second groove 54 by virtue of the floating structure of the hemming roller 30 and the guide roller 32, and working is performed over the total length of the flange 17.

In Step S12, the hemming roller 30 and the guide roller 32 are separated from the movable die 18 by keeping them slightly away from each other similarly to Step S8. Further, the hemming unit 20 is separated from the movable die 18.

In Step S13, opening of the movable die 18 is performed. That is, the knob 56 is grasped by the chuck 34 by bringing the hemming unit close to the rear face 49*b* after the direction of the hemming unit 20 is changed, and the opening and closing lever 68 of the clamping mechanism 58 is further opened by switching and driving the control valve 62.

In Step S14, standby processing is performed. That is, the robot 22 is moved to a predetermined standby position, and the movable die 18 is separated from the vehicle 12. The controller 24 notifies the production control computer that the hemming is normally completed. The production control computer that has received the notification confirms that other predetermined requirements also satisfy conditions, drives the production line 14, and conveys the vehicle 12 whose hemming is completed to a next process.

As such, according to the hemming apparatus 10*a*, hemming can be performed by bringing the movable die into contact with the vehicle 12 conveyed on the production-line 14 by using the small-sized lightweight movable die 18, and the exclusive space for hemming is unnecessary. Further, since the hemming is performed in the production line 14 similarly to other assembling and working processes, the time and effort for conveying the vehicle 12 to other exclusive spaces only for hemming is not required, and productivity improves. Moreover, according to the hemming apparatus 10*a*, since working is performed while the movable die 18 is brought into contact with the portion of a workpiece to be worked, the apparatus is applied irrespective of the size of workpieces.

Since the movable die 18 is small-sized and lightweight, a plurality of the movable dies can be stored in the storage rack 26, and their keeping and management are simple. Also, the robot 22 can select a movable die 18 according to the type of a vehicle, thereby performing hemming, and general versatility improves.

Furthermore, since the hemming roller 30 can be shared during the first roll hemming and the second roll hemming, replacement of the roller is unnecessary. Since the first groove 52 and the second groove 54 are provided in the rear face 49*b*, during the second hemming process, the flange 17 and the die plate 49 can be pinched and pressed by the cylindrical roller 40 and the guide roller 32. These operations are similarly obtained in the hemming apparatus 10*b* to be described later.

Moreover, according to the hemming apparatus 10*a*, one robot 22 can be used for both the moving means of the movable die 18 and the working means for hemming.

According to the hemming apparatus 10*a* and the hemming method, positioning and abutment between a workpiece and the movable die 18 can be rapidly and exactly performed by the robot 22.

Further, by providing the first groove 52 and the second groove 54 that guide the guide roller 32 in the movable die 18, and by supporting either the hemming roller 30 or the guide roller 32 in an axially displaceable manner, these rollers can be set in suitable positions with respect to a workpiece.

Next, a hemming apparatus 10*b* according to the second exemplary embodiment will be described with reference to FIGS. 9 to 11. In the main hemming apparatus, the same portions 10*b* as those of the hemming apparatus 10*a* are denoted by the same reference numerals, and the detailed description thereof is omitted.

Figure 9:
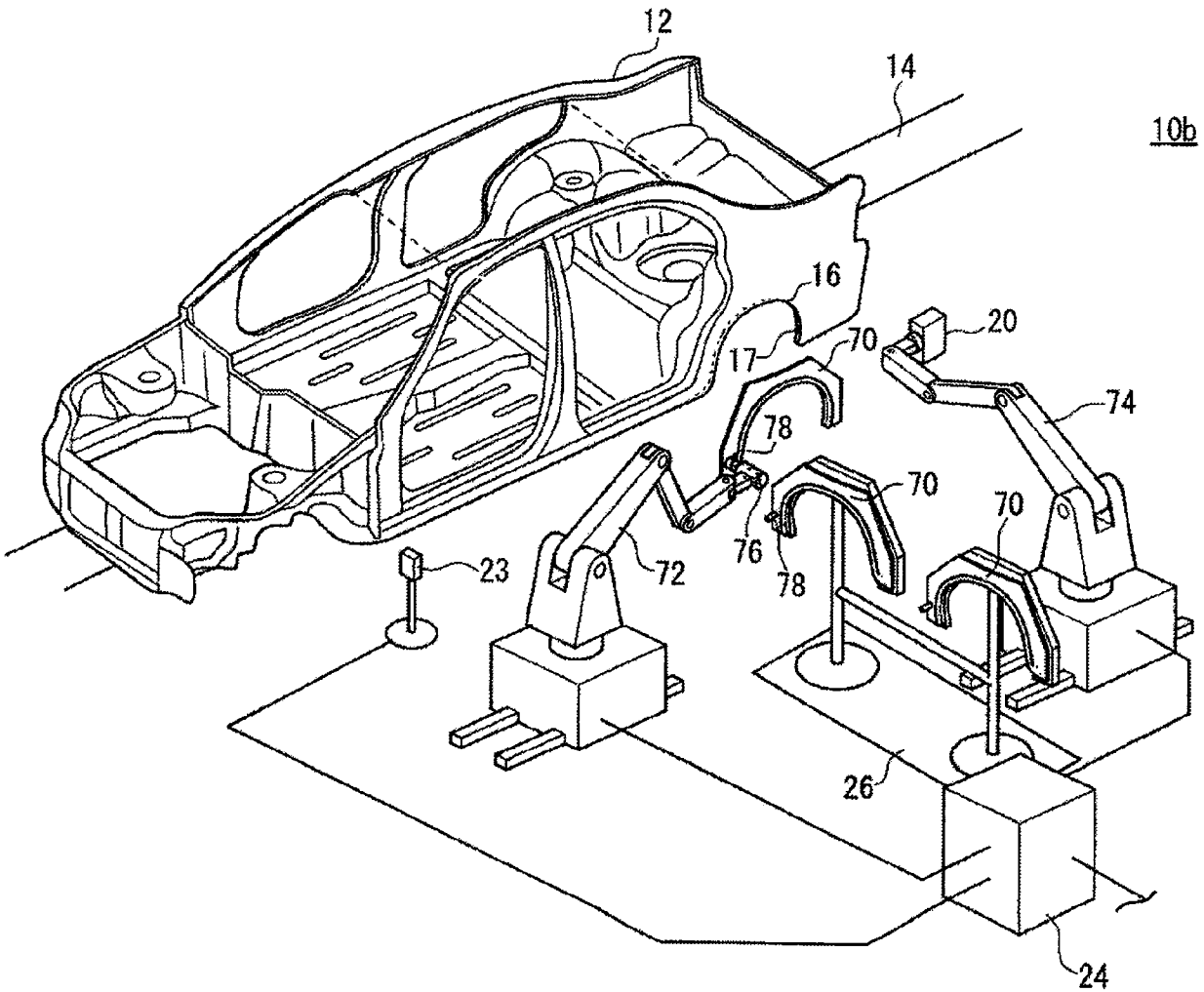
FIG. 9 is a perspective view of a hemming apparatus according to a second exemplary embodiment.

As shown in FIG. 9, the hemming apparatus 10*b* according to the second exemplary embodiment has a movable die 70 that is in contact with the wheel arch portion 16 of the vehicle 12 that is a workpiece, a robot 72 for a die that moves the movable die 70 and a working robot 74 that has a hemming unit 20 at its tip, a photoelectric sensor 23, and a controller 24. In addition, since the chuck 34 of the hemming unit 20 is not used if hemming is performed the hemming apparatus l0*b*, the chuck may be omitted. The working robot 74 has the same configuration as the robot 22. The robot 72 for a die is different from the robot 22 only at its tip. That is, a die grasping mechanism 76 for grasping a handle portion 78 of the movable die 70 is provided instead of the hemming unit 20.

Figure 10:
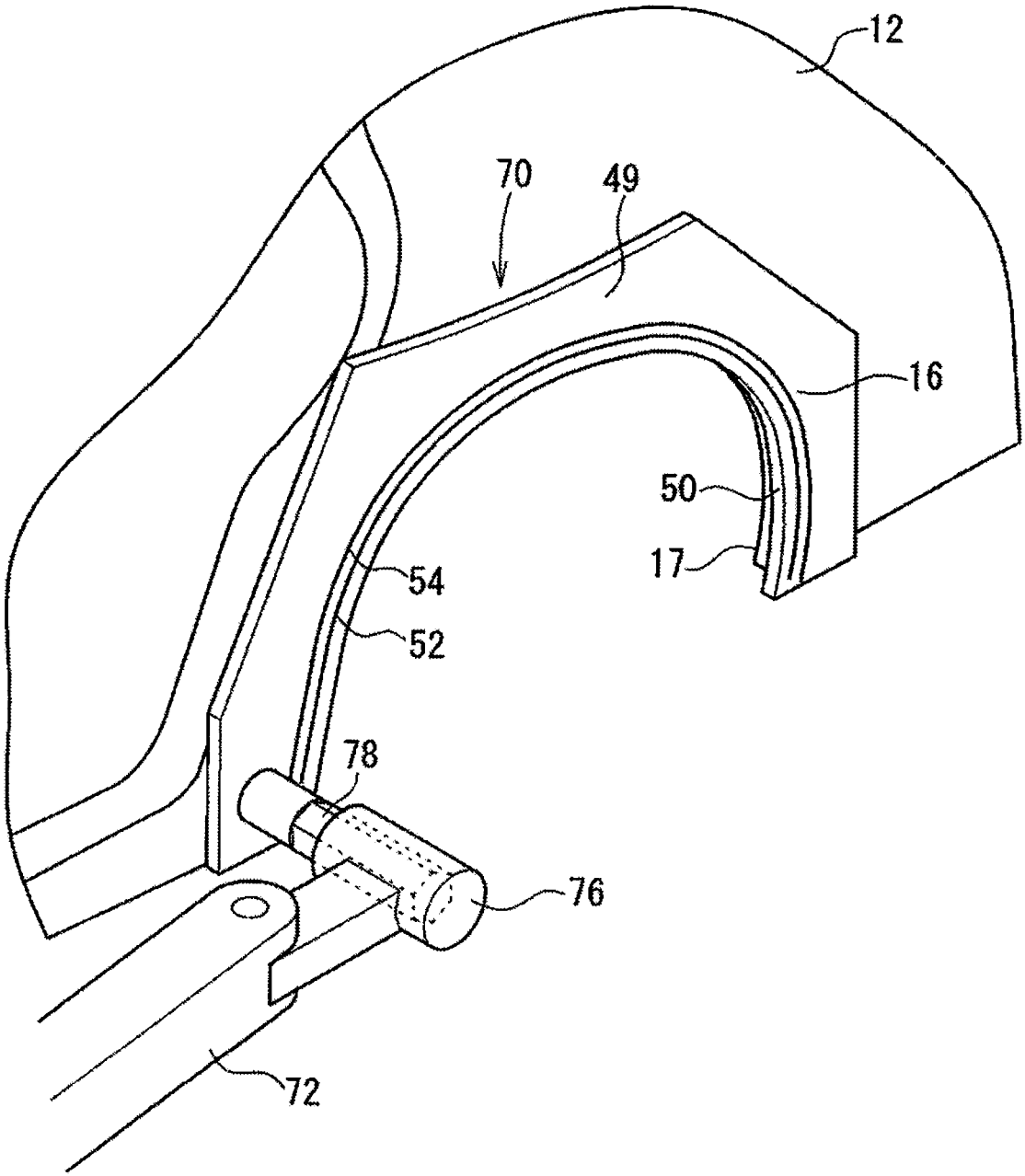
FIG. 10 is a perspective view of a movable die fixed to a wheel arch portion, in the hemming apparatus according to the second exemplary embodiment.
Figure 11:
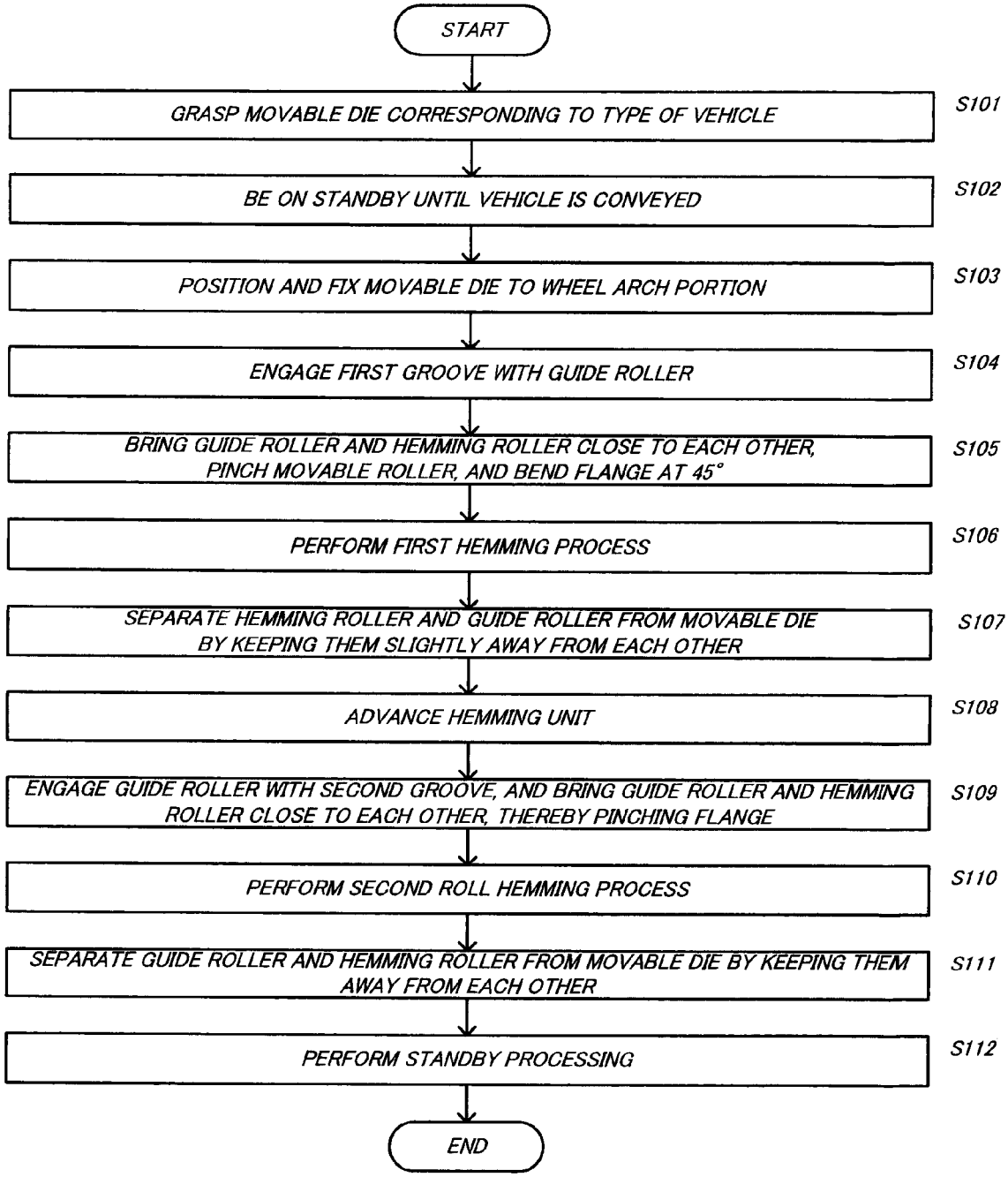
FIG. 11 is a flow chart showing the procedure of a hemming method by the hemming apparatus according to the second exemplary embodiment.

As shown in FIG. 10, the movable die 70 has a die plate 49, and a handle portion 78 that projects from a rear face 49*b* of the die plate 49. The handle portion 78 is set as a polygon in cross section in order to prevent rotational deviation of the die plate 49. The die plate 49 includes the same outside arc 50 first groove 52, and second groove 54 as the movable die 18. On the other hand, those that correspond to the knob 56, the clamping mechanism 58, the piping 60, and the control valve 62 do not exist, but the movable die 70 has a configuration that is still simpler than the movable die 18. The die grasping mechanism 76 corresponds to the chuck 34, and is able to exactly grasp the specified position of the handle portion 78 and to move the movable die 70 in an arbitrary posture in an arbitrary position by programming operation.

The robot 72 for a die and the working robot 74 are arranged side by side in the vicinity of the production line 14. A storage rack 26 is provided in the vicinity of the robot 72 for a die, and a plurality of movable dies 70 corresponding to the type of vehicles are stored in the storage rack. The position data of this storage rack 26 is stored in the controller 24.

Next, the working method of performing roll hemming of the flange 17 of the wheel arch portion 16 using the hemming apparatus 10*b* configured in this way will be described referring to FIG. 11.

In Step S101, after the information on the type of a vehicle 12 to be conveyed next is confirmed from a production control computer, the robot 72 for a die returns the currently grasping movable die 70 to the specified position of the storage rack 26, and grasps another movable die 70 corresponding to the type of the vehicle by means of the die grasping mechanism 76. That is, the robot 72 for a die performs the processing performed by the robot 22 in the above Step S1. At this time, the working robot 74 is on standby in a predetermined standby position.

In Step S102, the robot 72 for a die and the working robot 74 are on standby until the signal of the photoelectric sensor 23 is confirmed, and the vehicle 12 is conveyed, and moves to Step S103 when conveyance of the vehicle 12 is confirmed.

In Step S103, the working robot 72 is operated to bring the front face 49*a* of the movable die 70 into contact with the wheel arch portion 16 of a vehicle 12. At this time, the movable die is brought close to the vehicle while the route of the working robot 72 is corrected while the position of the movable die 70 relative to the wheel arch portion 16 is confirmed in real time by a predetermined sensor, and the movable die 70 is exactly positioned and fixed with respect to the wheel arch portion 16. Further, the positioning may be performed by providing a reference pin in the movable die 70, and by inserting the reference pin into a predetermined reference hole of the vehicle 12.

Thereafter, in Steps S104 to S111, the working robot 74 performs roll hemming on the flange 17. Since this working procedure is the same as the procedure performed by the robot 22 in the above Step S5 to S12, the detailed description thereof is omitted. In addition, during this period, the robot 72 for a die maintains its posture, and has stopped.

Further, in Step S112, standby processing is performed. That is, the movable die 70 is separated from the vehicle 12 by moving the robot 72 for a die and the working robot 74 to predetermined standby positions, respectively, and predetermined post processing is performed similarly to the above Step S14.

As such, according to the hemming apparatus 10*b* according to the second exemplary embodiment, the robot 72 for a die and the working robot 74 cooperate with each other to perform the holding of the movable die 70 and the working by the hemming unit 20. Thereby, the replacement processing of the movable die 70 (processing corresponding to the above Steps S4 and S13) is unnecessary, and the procedure is still simpler. As a result, working can be performed in a short time. Further, an actuator is unnecessary in the movable die 70, and simple and lightweight configuration is attained.

In addition, since the first groove 52 and the second groove 54 have a groove shape, the corresponding guide roller 32 can be made into a disk shape, which is preferable. Here, the first groove 52 and the second groove 54 may not necessarily have a groove shape as long as they guides the guide roller 32 (in other words, regulate the position in forward and reverse directions with respect to an X-axis). For example, as convex rails (guide strips), annular grooves may be provided at the peripheral surface of the guide roller 32.

Although the example where roll hemming is performed on the wheel arch portion 16 of the left rear wheel in the vehicle 12 is shown in the hemming apparatuses 10*a* and 10*b*, it is needless to say that the invention can be applied by setting a corresponding movable die even in a left wheel arch portion or other portions. As application portions where roll hemming is performed, for example, a front wheel housing edge, a door edge, a bonnet edge, a trunk edge, etc. in the vehicle 12, can be mentioned. Further, the roller hemming may include not only the case where one thin plate is bent, but also a case where an end of an inner panel that is a thin plate that is provided separately is pinched, for example, by bending the flange 17.

Here, a hemming unit 20*a* according to a modified example will be described in detail with reference to FIGS. 12 to 14. As for the hemming unit 20*a*, the hemming roller 30 and the guide roller 32 have a floating structure similarly to the hemming unit 20. In the hemming unit 20*a*, the same constituent portions as the hemming unit 20 are denoted by the same reference numerals, and the description thereof is omitted.

Figure 12:
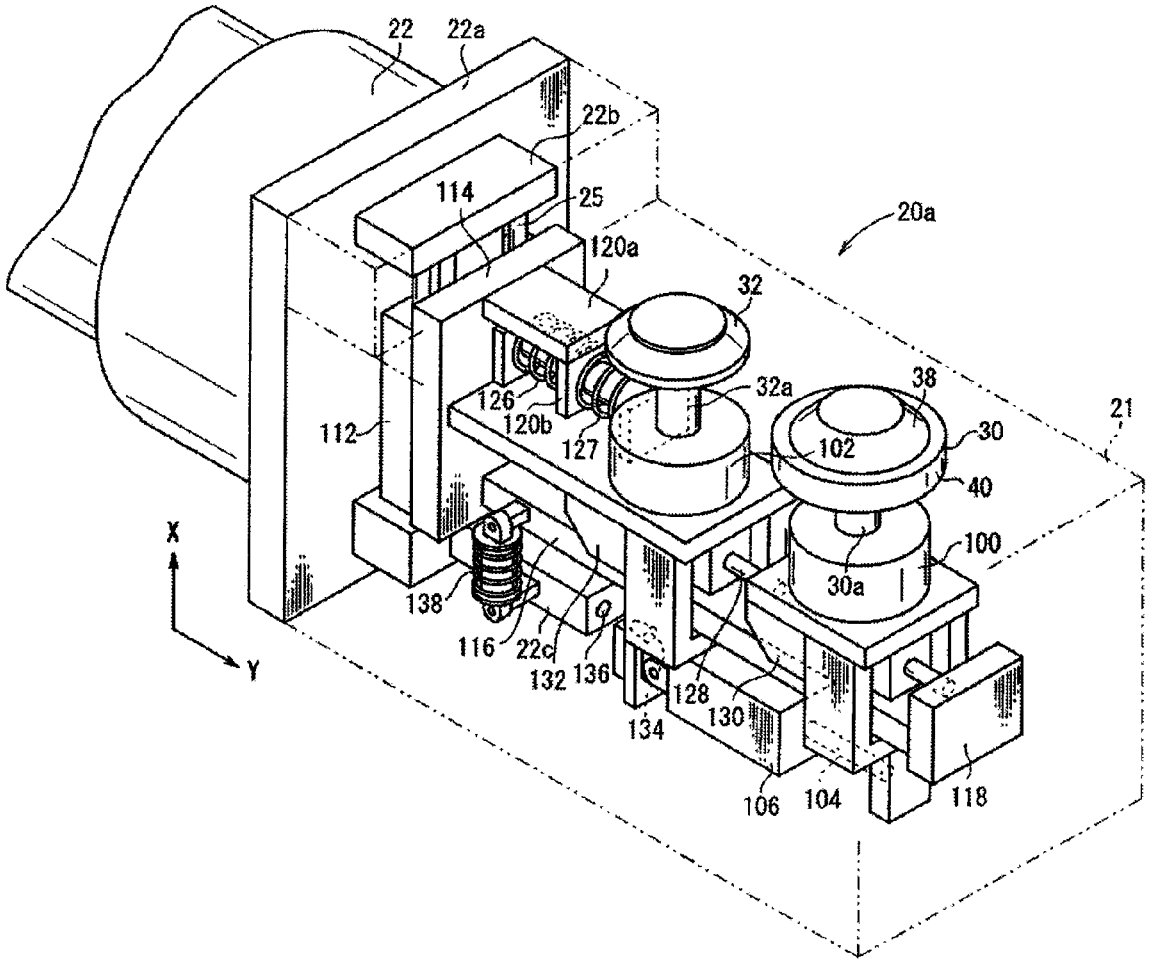
FIG. 12 is a perspective view of a hemming unit according to a modified example.
Figure 13:
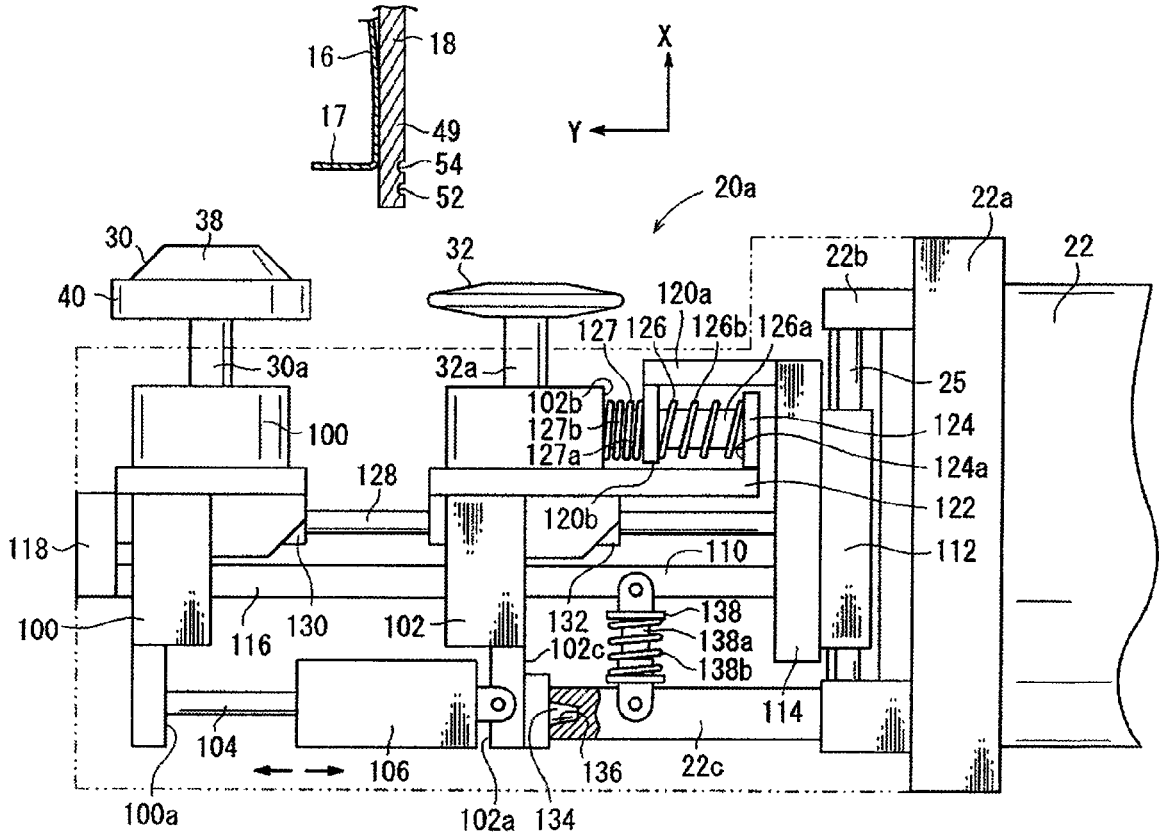
FIG. 13 is a partial cross-sectional side view showing a hemming unit according to the modified example before hemming.
Figure 14:
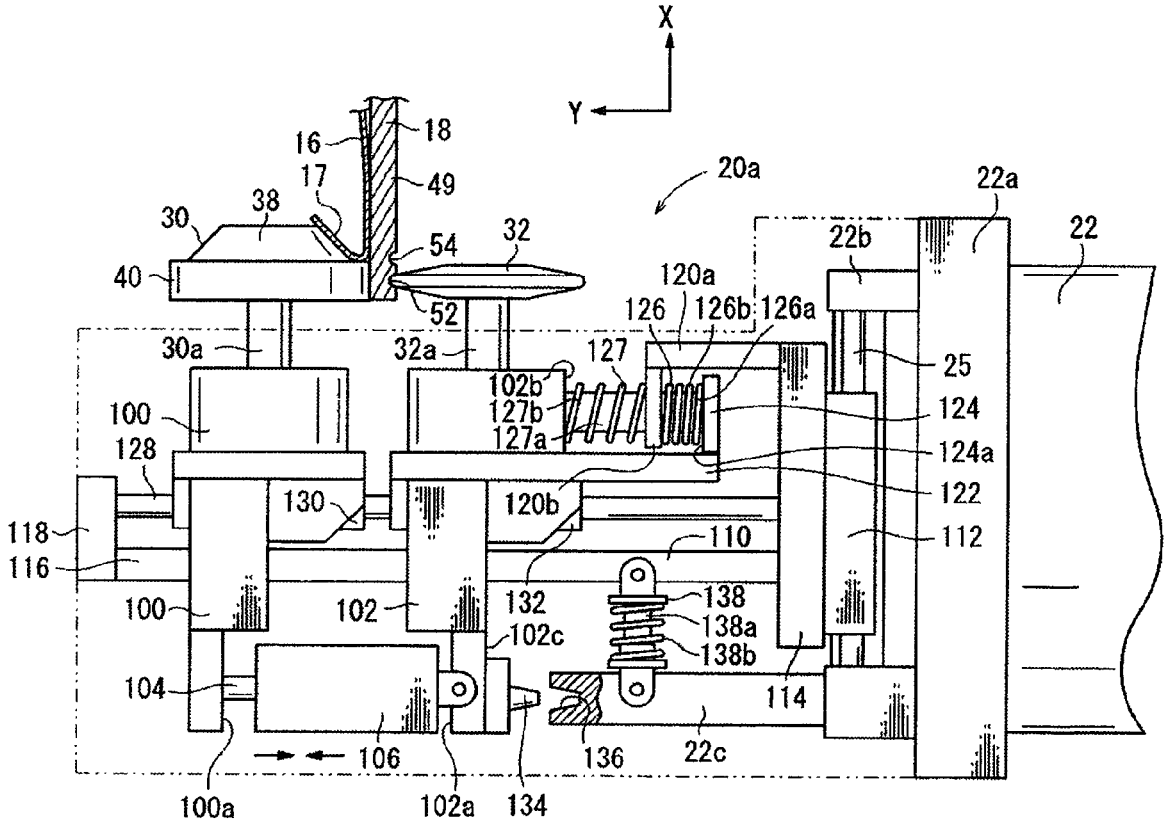
FIG. 14 is a partial cross-sectional side view showing the hemming unit according to the modified example during hemming.
Figure 15:
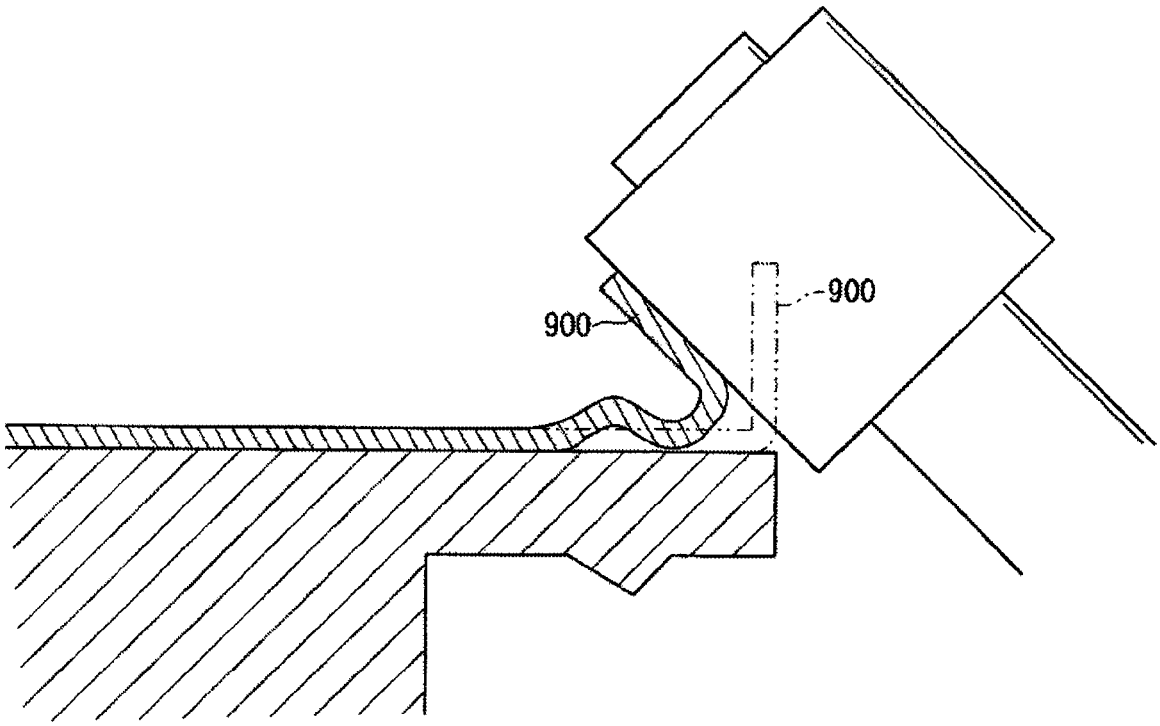
FIG. 15 is a sectional view of a flange during hemming according to a conventional technique.

FIG. 12 is a perspective view of the hemming unit 20*a*, FIG. 13 is a partially cross-sectional side view showing the hemming unit 20*a* before hemming, and FIG. 14 is a partially cross-sectional side view showing the hemming unit 20*a* during hemming. In addition, in FIGS. 12 to 14, an outer case 21 is transparently shown by two-dot chain lines so that the structure of the hemming unit 20*a* can be recognized visually.

The hemming unit 20*a* includes a hemming roller 30 and a guide roller 32, spindles 30*a* and 32*a* that journal these rollers, a first movable portion 100 serving as a movable portion that has the spindle 30*a* at an upper end face thereof, a second movable portion 102 serving as a movable portion that has the spindle 32*a* at an upper end face thereof, a cylinder 106 that is arranged so as to connect side faces 100*a* and 102*a* that face each other in lower portions of the first movable portion 100 and the second movable portion 102 to a rod 104, and that connects the first movable portion 100 and the second movable portion 102, and displaces them in the Y-direction, and a base portion 110 that supports the first movable portion 100, the second movable portion 102, and the cylinder 106 on the robot 22.

The base portion 110 has a substantially U-shape in which a lower side is longer than an upper side in side view (refer to FIG. 4). The base portion 110 has a third movable portion 114 that is supported on a second rail 25, which is fixed to a bracket 22*a*, and extends in the X-direction and is supported by a substantially U-shaped supporting member 22*b* in side view (refer to FIG. 4), so that it can be displaced in the X-direction via a linear guide 112, a rectangular base 116 that protrudes in the Y-direction from a middle slightly lower portion of the third movable portion 114 in the X-direction, a rectangular tip supporting member 118 that is provided at the tip face of the base 116, a rectangular flat plate 120*a* that protrudes in a direction parallel to the base 116 from the upper portion of the third movable portion 114, and a rectangular partitioning portion 120*b* that is provided at the tip of the flat plate 120*a* in parallel with the third movable portion 114. Further, a first supporting means 126 and a second supporting means 127 are disposed in series between a side face 102*b* in the upper portion of the second movable portion 102 on the side of the third movable portion 114, and a side face 124*a* of a supporting member 124 that protrudes in the X-direction from the tip of an extending portion 122 extending towards the third movable portion 114 from the second movable portion 102 so as not to be in contact with the flat plate 120*a*, and a partitioning portion 120*b* is provided between the first and second supporting means so as to partition them.

In the upper space of the base 116 where the third movable portion 114 and the tip supporting member 118 face each other, a first rail 128 extends parallel to the base 116. Also, the first movable portion 100 and the second movable portion 102 are supported on the first rail 128 so that they can be displaced in the Y-direction possible via linear guides 130 and 132, respectively. That is, the first movable portion 100 and the second movable portion 102 are supported by the base portion 110 via the linear guides 130 and 132, etc, and they function as a movable mechanism. Further, the second movable portion 102 is resiliently supported in a driven manner in the Y-direction by the first supporting means 126 and the second supporting means 127 by the interposition of the partitioning portions 120*b*. That is, if the second movable portion 102 is displaced in a direction away from the first movable portion 100, the second supporting means 127 will be contracted by the partitioning portion 120*b*, and if the second movable portion 102 the second movable portion is displaced in a direction in which it approaches the first movable portion 100, the first supporting means 126 will be contracted by the partitioning portion 120*b*.

Moreover, a horizontally extending portion 22*c* that protrudes in the Y-direction from a lower end face of the supporting member 22*b*, and the base 116 are resiliently supported in a driven manner by a third supporting means 138. Although a pair of the third supporting means are provided so as to connect both ends of the horizontally extending portion 22*c* and base 116, it is needless to say that single third supporting means may be provided so as to connect central portions of the horizontally extending portion 22*c* and base 116 in the width direction.

Further, the first supporting means 126, the second supporting means 127, and the third supporting means 138 have all the same configuration. The first supporting means 126 is composed of a shank 126*a* and a spring 126*b* installed around the shank 126*a*, and the second supporting means 127 is composed of a shank 127*a* and a spring 127*b* arranged around the shank 127*a*. Similarly, the third supporting means 138 is composed of a shank 138*a* and a spring 138*b* installed around the shank 138*a*. In addition, for example, a hydraulic damper or a pneumatic damper may constitute each of the above-mentioned shanks 126*a*, 127*a*, and 138*a*.

Since the first supporting means 126 and the second supporting means 127 have the configuration as described above, the second movable portion 102 is supported on the base portion 110 so as to be displaceable in the Y-direction by the linear guide 132, and is resiliently supported in driven manner in the Y-direction on the base portion 110 via the partitioning portion 120*b* by the first supporting means 126 and the second supporting means 127. Similarly, since the third supporting means has the configuration as described above, the base 116 is resiliently supported in a driven manner in the X-direction on the horizontally extending portion 22*c* fixed to the robot 22 by the third supporting means.

Meanwhile, the second movable portion 102 has one side face 102*a* and the other side face 102*c* that extend downward. The other side face 102*c* is provided with a first stopper 134 as a first locking portion, and the first stopper 134 is capable of being engaged with a second stopper 136 provided at the tip of the horizontally extending portion 22*c*. That is, the tip of the first stopper 134 is formed as a convex portion substantially in the shape of a truncated cone, and the second stopper 136 is formed as a concave portion substantially in the shape of a mortar that allows the tip of the first stopper 134 to be inserted thereinto. For this reason, as shown in FIG. 4, the first stopper 134 and the second stopper 136 are engaged with each other in a state where the rod 104 of the cylinder 106 is protruded and the spacing between the hemming roller 30 and the guide roller 32 is open to the maximum, i.e., in a state where the hemming roller 30 before or after the hemming to be described later is separated from the vehicle 12. On the other hand, as shown in FIG. 5, the first stopper 134 and the second stopper 136 are not engaged with each other in a state where the rod 104 of the cylinder 106 is retracted and the spacing between the hemming roller 30 and the guide roller 32 is pinched, i.e., in a state where the hemming roller 30 during the hemming to be described later is contact with the vehicle 12.

In addition, in a state (refer to FIG. 4) where the rod 104 of the cylinder 106 is protruded and the first stopper 134 and the second stopper 136 are engaged with each other, the first movable portion 100 is brought into contact with and supported by the tip supporting member 118 by a pressing force in a direction opposite to the second movable portion 102 by the rod 104 connected to the cylinder 106. On the other hand, in a state (refer to FIG. 5) where the rod 104 of the cylinder 106 is retracted and the first stopper 134 and the second stopper 136 are not engaged with each other, the first movable portion 100 is held in a state where it is brought close to the second movable portion 102 by an attractive force toward the second movable portion 102 by the rod 104.

It is needless to say that that the hemming apparatus and hemming method according to the invention are not limited the aforementioned embodiments, but various configurations can be adopted without departing from the scope and spirit of the invention.

This application is based on Japanese Patent Application No. 2005-180611, filed on Jun. 21, 2005, and Japanese Patent Application No. 2006-164485, filed on Jun. 14, 2006, the entire contents of which are incorporated herein by reference.

INDUSTRIAL APPLICABILITY

The invention is applicable in a hemming method and a hemming apparatus that bend a flange provided at an end of a workpiece in conformity with a die.

The invention claimed is:

1. A hemming method comprising:

a positioning step of bringing a forward surface of a movable die having a guide strip into contact with a workpiece and positioning the movable die so that the guide strip is substantially parallel to a flange at an end of the workpiece;

a working step of rolling a guide roller while the guide roller is engaged with the guide strip, and performing hemming on the flange by a hemming roller that rolls in an interlocking manner with the guide roller; and a separating step of separating the movable die from the workpiece after the hemming, wherein the guide strip includes a first guide strip provided on a rear surface of the moveable die and a second guide strip provided on the rear surface of the movable die, and the working step comprises:

a first hemming step of rolling the guide roller while the guide roller is engaged with the first guide strip, and inclining the flange while the hemming roller is in contact with the flange, and a second hemming step of rolling the guide roller while the guide roller is engaged with the second guide strip, and pinching the flange and the movable die by the hemming roller and the guide roller.

2. The hemming method according to claim 1, wherein the movable die is attached to the workpiece so that the movable die is positioned and fixed with respect to the workpiece.

3. The hemming method according to claim 1, wherein the movable die has a plate shape, the first guide strip is provided on an outer side of the end of the flange, and the second guide strip is provided on an inner side of the end of the flange, the hemming roller includes a tapered roller tapered toward the inner side of the end of the flange and provided on a tip of the hemming roller, and a cylindrical roller formed in a cylindrical shape and provided on a base end of the hemming roller, and the working step comprises:

inclining the flange while the tapered roller is in contact with the flange, and pinching the flange and the movable die by the cylindrical roller and the guide roller.

4. A hemming apparatus comprising:

a moveable die including a front face to be in contact with a workpiece having a flange, and a rear face provided with a first guide strip and a second guide strip that are substantially parallel to the flange;

a guide roller that engages with the first guide strip or the second guide strip according to a process; and a hemming roller that interlocks with the guide roller and performs hemming on the flange, wherein the first guide strip is provided on an outer side of the end of the flange, the second guide strip is provided on an inner side of the end of the flange, and the hemming roller includes a tapered roller tapered toward the inner side of the end of the flange and provided on a tip of the hemming roller, the tapered roller engaging the flange as the guide roller is engaged with the first guide strip, and a cylindrical roller formed in a cylindrical shape and provided on a base end of the hemming roller, the cylindrical roller engaging the flange as the guide roller is engaged with the second guide strip.

5. A hemming method of bending a flange of a workpiece that is positioned in a predetermined station, the method comprising:

a first step of conveying a movable die located in a vicinity of the station by a die moving means, and bringing a first surface of the moveable die into contact with the workpiece; and a second step of pinching the workpiece by the movable die and a hemming roller, and bending the flange while the hemming roller is rolled on the flange, wherein a second surface of the movable die includes a guide strip including a first guide strip and a second guide strip, the hemming roller is connected to a guide roller, the guide roller being selectively guided by one of the first guide strip and the second guide strip, and in the second step, working is performed on the flange by the hemming roller while the guide roller is rolled following the guide strip.

6. The hemming method according to claim 5, wherein the die moving means is an articulated robot that is operable by a program.

7. The hemming method according to claim 5, wherein, in the second step, the flange is bent by moving the hemming roller by a roller moving means, while the movable die is held in a state where the movable die is in contact with the workpiece by the die moving means.

8. A hemming method of bending a flange of a workpiece that is positioned in a predetermined station, the method comprising:

a first step of conveying a movable die located in a vicinity of the station by a die moving means, and bringing the moveable die into contact with the workpiece; and a second step of pinching the workpiece by the movable die and a hemming roller, and bending the flange while the hemming roller is rolled on the flange, wherein the die moving means holds the hemming roller and the movable die, in the first step, the movable die is fixed to the workpiece by a positioning and fixing means, and then the movable die is separated from the die moving means, and in the second step, the flange is bent by moving the hemming roller by the die moving mean, while the movable die is held in a state where the movable die is in contact with the workpiece by the positioning and fixing means.

9. A hemming method of bending a flange of a workpiece that is positioned in a predetermined station, the method comprising:

a first step of conveying a movable die located in a vicinity of the station by a die moving means, and bringing the moveable die into contact with the workpiece; and a second step of pinching the workpiece by the movable die and a hemming roller, and bending the flange while the hemming roller is rolled on the flange, wherein the guide strip that is substantially parallel to the flange in a state where the movable die is in contact with the workpiece in the first step, the hemming roller is connected to a guide roller guided by the guide strip, and in the second step, working is performed by the hemming roller while the guide roller is rolled following the guide strip.

10. A hemming apparatus for bending a flange of a workpiece that is positioned in a predetermined station, the apparatus comprising:

plural types of movable dies arranged in a vicinity of the station;

a die moving means that selects and brings one of the moveable dies corresponding to the workpiece into contact with the workpiece;

a hemming roller that bends the flange while the hemming roller is rolled on the flange; and a roller moving means that moves the hemming roller along the flange, wherein the movable die includes a guide strip that is substantially parallel to the flange in a state where the movable die is in contact with the workpiece, the hemming roller is connected to a guide roller guided by the guide strip, and working is performed by the hemming roller while the guide roller is rolled following the guide strip.

11. The hemming apparatus according to claim 10, wherein the moveable die includes a forward surface which is in contact with the workpiece and a rear surface on which the guide strip is provided, and wherein the hemming roller and the guide roller are configured to pinch the workpiece and the moveable die between the hemming roller and the guide roller.

12. The hemming apparatus according to claim 11, wherein the guide strip comprises a groove.

13. A The hemming apparatus for bending a flange of a workpiece that is positioned in a predetermined station, the apparatus comprising:

plural types of movable dies arranged in a vicinity of the station;

a die moving means that selects and brings one of the moveable dies corresponding to the workpiece into contact with the workpiece;

a hemming roller that bends the flange while the hemming roller is rolled on the flange; and a roller moving means that moves the hemming roller along the flange, wherein the movable die includes a guide strip that is substantially parallel to the flange in a state where the movable die is in contact with the workpiece, the hemming roller is connected to a guide roller guided by the guide strip, and working is performed by the hemming roller while the guide roller is rolled following the guide strip, and wherein the hemming roller and the guide roller are supported in an axially displaceable manner on the basis of the roller moving means while their relative positions are held.

14. A hemming apparatus comprising:

a moveable die including a guide strip;

a guide roller that is rolled while its axial position is restricted by the guide strip;

a hemming roller that performs hemming on a flange;

a hemming unit that supports the guide roller and the hemming roller; and a roller moving means that moves the hemming unit so that working is performed by the hemming roller while the guide roller is rolled following the guide strip, wherein the hemming unit supports at least one of the hemming roller and the guide roller in an axially displaceable manner, wherein in a first hemming step, the guide roller and the hemming roller are in a first position, the guide roller is engaged with the guide strip and the flange is inclined by the hemming roller, and wherein in a second hemming step, at least one of the guide roller and hemming roller is axially displaced to a second position, the guide roller is engaged with the guide strip and the flange and the movable die are pinched by the hemming roller and the guide roller.

15. The hemming apparatus according to claim 14, wherein the hemming unit supports the guide roller and the hemming roller in an axially displaceable manner while holding their relative positions.

16. The hemming apparatus according to claim 14, wherein the roller moving means is an articulated robot that is operable by a program.

* * * * *